US006213834B1

(12) United States Patent
Ohnishi et al.

(10) Patent No.: US 6,213,834 B1
(45) **Date of Patent: *Apr. 10, 2001**

(54) METHODS FOR MAKING ELECTRON EMISSION DEVICE AND IMAGE FORMING APPARATUS AND APPARATUS FOR MAKING THE SAME

(75) Inventors: Toshikazu Ohnishi, Sagamihara; Masanori Mitome, Tsukuba, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/292,014

(22) Filed: Apr. 15, 1999

(30) Foreign Application Priority Data

Apr. 23, 1998 (JP) ..... 10-113196

(51) Int. Cl.[7] ..... H01J 9/02
(52) U.S. Cl. ..... 445/6; 445/24
(58) Field of Search ..... 445/6, 24

(56) References Cited

U.S. PATENT DOCUMENTS 5,066,883 * 11/1991 Yoshioka et al. ..... 313/309
5,853,310 12/1998 Nishimura et al. ..... 445/24

FOREIGN PATENT DOCUMENTS 0 660 357 * 6/1995 (EP) .
0788130 8/1997 (EP) .
0803892 10/1997 (EP) .
1-031332 * 2/1989 (JP) .
1-283749 * 11/1989 (JP) .
2-257552 * 10/1990 (JP) .

OTHER PUBLICATIONS

Dyke, W.P., et al., "Field Emission," Advances in Electronics and Electron Physics, New York: Academic Press, Inc. (1956), pp. 89–185.*
Elinson, M.I., et al., "The Emission of Hot Electrons and the Field Emission of Electrons from Tin Oxide," Radio Engineering and Electronic Phys., No. 7 (1965), pp. 1290–1296.*
Mead, C.A., "Operation of Tunnel–Emission Devices," Journal of Applied Physics, vol. 32, No. 4 (1961), pp. 646–652.*
Dittmer, G., "Electrical Conduction and Electron Emission of Discontinuous Thin Films," Thin Solid Films, vol. 9 (1972), pp. 317–328.*
Hartwell, M., et al., "Strong Electron Emission from Patterned Tin–Indium Oxide Thin Films," International Electron Devices Meeting (1975), pp. 519–521.*
Spindt, C.A., et al., "Physical Properties of Thin–Film Field Emission Cathodes with Molybdenum Cones," Journal of Applied Physics, vol. 47, No. 12 (1976), pp. 5248–5263.*
Araki, H., et al., "Electroforming and Electron Emission of Carbon Thin Films," Journal of the Vacuum Society of Japan, vol. 26, No. 1 (1983), pp. 22–29.*
Patent Abstracts of Japan; vol. 1998, No. 04, Mar. 31, 1988 & JP 09 330653, Dec. 22, 1997.

* cited by examiner

*Primary Examiner*—Kenneth J. Ramsey
(74) *Attorney, Agent, or Firm*—Fitzpatrick, Cella, Harper & Scinto

(57) ABSTRACT

A method for making an electron emission device, which includes a conductive film having an electron emitting section disposed between a pair of electrodes, includes a removal step for removing impurities in a organic substance, and a voltage-applying step for applying an voltage to the conductive film through the electrodes in an atmosphere containing the organic substance. The electron emission device is suitable for an electron beam source in an image forming apparatus.

18 Claims, 25 Drawing Sheets

METHODS FOR MAKING ELECTRON EMISSION DEVICE AND IMAGE FORMING APPARATUS AND APPARATUS FOR MAKING THE SAME

BACKGROUND OF THE INVENTION

1. Field of the Invention

The present invention relates to methods for making an electron emission device and an image forming apparatus, and to an apparatus for making the same.

2. Description of the Related Art

Conventional electron emission devices are classified into thermal electron source devices and cold cathode electron source devices. The cold cathode electron source devices include field emission (hereinafter referred to as FE) types, metal-insulator-metal (hereinafter referred to as MIM) types, and surface conduction types.

FE type devices are disclosed by, for example, W. P. Dyke & W. W. Dolan ("Field Emission", Advances in Electron Physics, Vol. 8, 89 (1956)), and by C. A. Spindt ("Physical Properties of Thin-Film Field Emission Cathodes with Molybdenum Cones", J. Appl. Phys., Vol. 47, 5248 (1976)). MIM type devices are disclosed by, for example, C. A. Mead % ("The Tunnel-Emission Amplifier", J. Appl. Phys., Vol. 32, 646 (1961)). Surface conduction type devices are disclosed by, for example, M. I. Elinson (Radio Eng. Electron Phys., Vol. 10, 1290 (1965)).

In surface conduction electron emission devices, when a current flows along the plane of a thin film with a small area formed on a substrate, electrons are emitted. Examples of thin films disclosed as surface conduction electron emission devices include an $SnO_2$ thin film by Elinson as described above, a gold thin film by G. Dittmer (Thin Solid Films, Vol. 9, 317–328 (1972)), an $In_2O_3/SnO_2$ thin film by M. Hartwell and C. G. Fonstad (IEEE Trans. ED Conf., p. 519 (1975)), and a carbon thin film by H. Araki et al. (Sinku (Vacuum), Vol. 26, No. 1, 22 (1983)).

FIG. 25 shows a configuration of the above device by M. Hartwell as a typical example of a surface conduction electron emission device. A conductive film 4 having an H shape is formed on a substrate 1. The conductive film 4 is composed of the above-described composite metal oxide. The conductive film 4 is subjected to an electrifying process generally called "electrifying forming" to form an electron emitting section 5. In the drawing, two device electrodes have a total length L in the range of 0.5 to 1.0 mm, and a width W' of approximately 0.1 mm.

In the surface conduction electron emission device, the electron emitting section 5 is generally formed by the "electrifying forming" process of the conductive film 4 prior to electron emission. In the electrifying forming, a voltage is applied to two ends of the conductive film 4 to locally destruct, deform or modify the conductive film 4. As a result, the electron emitting section 5 having high electrical resistance is formed. The electron emitting section 5 includes cracks and electrons are emitted near the cracks.

Examples of arrays of many surface conduction electron emission devices are ladder-type electron sources disclosed in, for example, Japanese Patent Application Laid-Open Nos. 64-31332, 1-283749, and 2-257552, in which many lines of surface conduction electron emission devices are arranged, and two ends (electrodes) of each devices are connected to lead lines (common lead lines).

An array of surface conduction electron emission devices enables production of a planar display device similar to a liquid crystal display device. U.S. Pat. No. 5,066,883 discloses such a display device which comprises a combination of an electron source including many surface conduction electron emission devices and a fluorescent coating which is irradiated with electrons from the electron source to emit visible light.

Preferably, a voltage is applied to the electron emission device subjected to electrifying forming in an atmosphere containing an organic substance in order to improve electron emission characteristics (hereinafter referred to as an activation step). The voltage applied in the activation step is substantially equal to the voltage applied in the forming step. Carbon and/or carbonaceous materials are deposited on and near the electron emitting section 5 during the activation step, as disclosed, for example, in European Patent Application Laid-Open No. 0660357.

SUMMARY OF THE INVENTION

It is an object of the present invention to provide a method for making an electron emission device having superior electron emission characteristics.

It is another object of the present invention to provide a method for making an image forming apparatus using such electron emission devices.

It is still another object of the present invention to provide an apparatus for making electron emission devices.

It is a further object of the present invention to provide a method and an apparatus for making an image forming apparatus capable of forming higher quality images.

A method for making an electron emission device including a conductive film having an electron emitting section disposed between a pair of electrodes, includes a removal step for removing impurities in an organic substance, and a voltage-applying step for applying an voltage to the conductive film through the electrodes in an atmosphere containing the organic substance.

In an embodiment of the method, the removal step may include removing atmospheric components, such as oxygen and nitrogen, contained in the organic substance when the organic substance is introduced from a supply source of the organic substance into a treating unit for performing the voltage-applying step.

Preferably, the atmospheric components contained in the organic substance are removed by a freeze and thawing method. Preferably, the organic substance is introduced to the treating unit without contact with air after the atmospheric components contained in the organic substance are removed.

Another aspect of the present invention is a method for making an image forming apparatus including at least one electron emission device and an image forming member for forming an image by electrons emitted from the electron emission device, wherein the electron emission device is made by the above-described method.

Another aspect of the present invention is an apparatus for making an electron emission device including a pair of electrodes and a conductive film having an electron emitting section disposed between the electrodes. The apparatus includes a container for containing a substrate including a pair of electrodes and a conductive film disposed between the electrodes, a first evacuating means for evacuating the container, a voltage applying means for applying an voltage between the electrodes, a gas supply means for supplying a vaporized organic substance from a supply source to the vessel, and a second evacuating means for evacuating the interior of the supply source.

Another aspect of the present invention is an apparatus for making an electron emission device including a pair of electrodes and a conductive film having an electron emitting section disposed between the electrodes. The apparatus includes a container for containing a substrate including a pair of electrodes and a conductive film disposed between the electrodes, an evacuating means for evacuating the container, a voltage applying means for applying an voltage between the electrodes, a gas supply means for supplying a vaporized organic substance from a supply source to the vessel, and a gas exhausting line for evacuating the interior of the supply source from the evacuating means without through the container.

Further objects, features and advantages of the present invention will become apparent from the following description of the preferred embodiments with reference to the attached drawings.

DESCRIPTION OF THE PREFERRED EMBODIMENTS

The preferred embodiments in accordance with the present invention will now be described with reference to the attached drawings.

An electron emission device in accordance with the present invention has two basic configurations, that is, a planar configuration and an upright configuration. First, a planar electron emission device will be described.

Figure 1A:
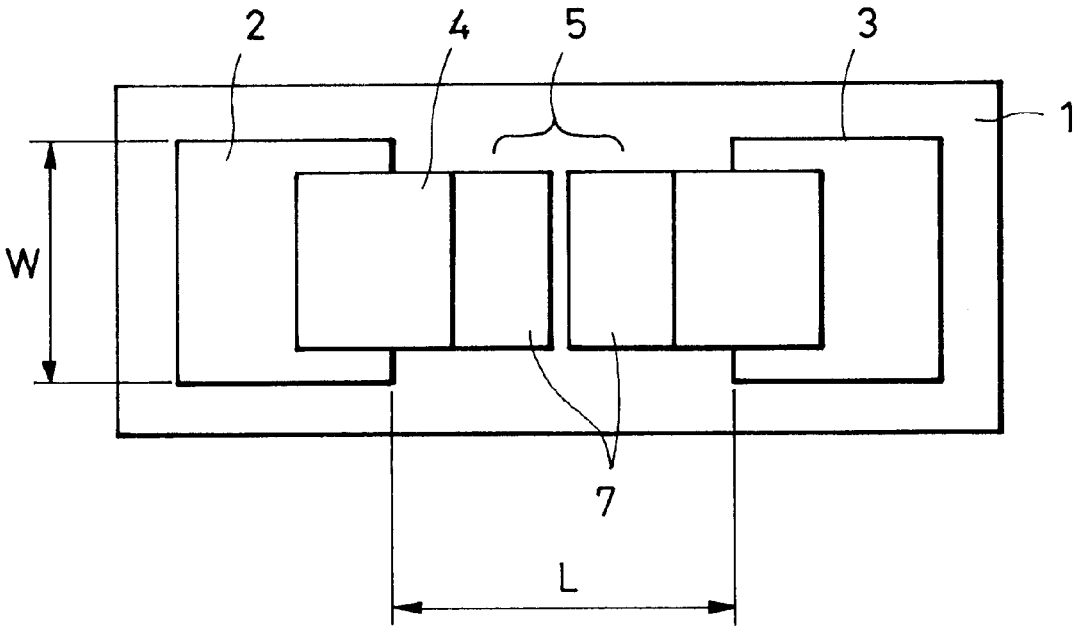
FIGS. 1A and 1B are a schematic plan view and a cross-sectional view, respectively, of an embodiment of an electron emission device in accordance with the present invention.
Figure 1B:
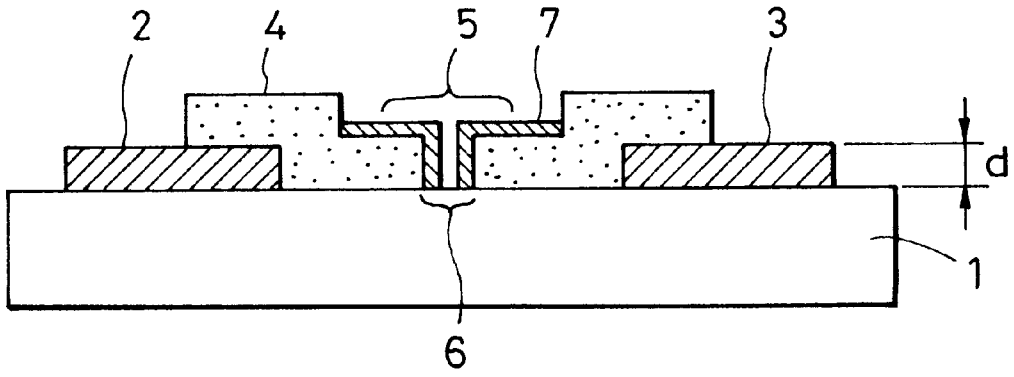

FIGS. 1A and 1B are a schematic plan view and a cross-sectional view, respectively, of an embodiment of a planar electron emission device in accordance with the present invention. The electron emission device is formed on a substrate 1, and includes two electrodes 2 and 3, a conductive film 4, and an electron emitting section 5. The electron emitting section 5 includes a gap, such as a crack, which is formed in the conductive film 4, and thin films 7 composed of carbon or carbonaceous materials are formed on the conductive film 4 to narrow the gap 6.

The substrate 1 may be composed of quartz glass, a purified glass with a reduced content of impurities such as sodium components, a blue flat glass, a composite glass substrate comprising a blue flat glass and a $SiO_2$ layer deposited thereon by a sputtering process or the like, a ceramic such as alumina, or a silicon substrate.

The opposing electrodes 2 and 3 may be composed of a general conductive or semiconductive material. Examples of such materials include metals and alloys thereof, e.g., Ni, Cr, Au, Mo, W, Pt, Ti, Al, Cu, and Pd; printed conductors comprising metals and metal oxides, e.g., Pd, Ag, Au, $RuO_2$, and Pd—Ag, printed on substrates such as glass; transparent conductors such as $In_2O_3$—$SnO_2$; and semiconductors such as polysilicon.

The distance L between the electrodes 2 and 3, the width of the electrodes 2 and 3, and the shape of the conductive film 4 can be determined in consideration of the application of the device. In general, the distance L between the electrodes 2 and 3 is in a range of several hundreds of nanometers to several hundreds of micrometers, and preferably several micrometers to several tens of micrometers in view of the voltage applied to these electrodes 2 and 3. The width W of the electrodes 2 and 3 is in a range of several micrometers to several hundreds of micrometers in view of the resistance of the electrodes 2 and 3 and electron emitting characteristics. The thickness d of the electrodes 2 and 3 is in a range of several tens of nanometers to several micrometers.

In addition to the above configuration, the conductive film 4 and then the two opposing electrodes 2 and 3 may be deposited on the substrate 1.

Examples of materials for the conductive film 4 include metals, e.g., Pd, Pt, Ru, Ag, Au, Ti, In, Cu, Cr, Fe, Zn, Sn, Ta, W, and Pb; oxides, e.g., PdO, $SnO_2$, $In_2O_3$, PoO, and $Sb_2O_3$; borides, e.g., $HfB_2$, $ZrB_2$, $LaB_6$, $CeB_6$, $YB_4$, and $GdB_4$; carbides, e.g., TiC, ZrC, HfC, TaC, SiC, and WC; nitrides, e.g., TiN, ZrN, and HfN; semiconductors, e.g., Si and Ge; and carbonaceous materials.

The conductive film 4 is preferably composed of a fine-particle thin film containing fine particles having superior electron emitting characteristics. The thickness of the conductive film 4 may be determined in consideration of step coverage with respect to the electrodes 2 and 3 and the resistance of the electrodes 2 and 3. The thickness is preferably in a range of several angstroms to several hundreds of nanometers, and more preferably 1 nanometer to 50 nanometer. The sheet resistance Rs of the electrodes 2 and 3 is in a range of $10^2$ to $10^7$ Ω. The sheet resistance is determined by the equation R=Rs(l/w) wherein Rs is the resistance, w is the width, and l is the length of the conductive film 4.

"Fine-particle film" means a film containing a plurality of fine particles. These fine particles may have fine textures in which fine particles are separately dispersed in the film or agglomerated to form islands. The size of the fine particles is in a range of several angstroms to several hundreds of nanometers, and preferably 1 nanometer to 20 nanometers.

The meaning of "fine particle", frequently appearing in the present invention, will now be described. Particles having small diameters are called fine particles and particles having smaller diameters than the fine particles are called "ultrafine particles". Particles having smaller diameters than the ultrafine particles and comprising several hundreds of atoms are called "clusters". There is no strict boundary between these particles and the clusters, and thus such classification depends on aspects of properties. The "fine particles" in the present invention include both "fine particles" and "ultrafine particles".

The following description is cited from "Experimental Physics Vol. 14, Surface & Fine Particles" (edited by Koreo Kinoshita; published by Kyoritsu Shuppan; Sep. 1, 1986). "Fine particles" in this book have a diameter ranging from approximately 2 to 3 μm to 10 nm, and ultrafine particles have a diameter ranging from approximately 10 nm to 2 to 3 nm. The boundary between the fine particles and the ultrafine particles is not strict and is merely a standard, because both are termed "fine particles" in some cases. Particles comprising two atoms to several tens or several hundreds of atoms are called clusters (page 195, lines 22 to 26).

In addition, according the definition of "ultrafine particles" in the Hayashi Ultrafine Particle Project of the Research Development Corporation of Japan, the lower limit of the particle size is smaller, as follows. "In the 'Ultrafine Particle Project' of the Creative Scientific Technology Promotion System, particles having a particle size in a range of approximately 1 to 100 nm are called 'ultrafine particles'. Thus, an ultrafine particle is composed of approximately 100 to $10^8$ atoms. From the viewpoint of atoms, ultrafine particles are large particles to giant particles." ("Ultrafine Particles in Creative Scientific Technology" edited by Chikara Hayashi, Ryoji Ueda, and Akira Tazaki, page 2, lines 1 to 4; Mita Shuppan (1988)) "That which is smaller than the ultrafine particle, that is, composed of several to several hundreds of atoms, is generally called a cluster." (ibid., page 2 lines 12 to 13) Taking into consideration these descriptions, the "ultrafine particle" in the present invention means an agglomerate composed of many atoms or molecules, and has a lower limit of the particle size in a range of several angstroms to approximately one nanometer and an upper limit of several micrometers.

The electron emitting section 5 includes a gap 6 formed of a thin film 7 which is composed of carbon or carbonaceous materials and includes the vicinity of the gap 6. The gap 6 may contain conductive fine particles having a particle size in a range of several angstroms to several tens of nanometers in the interior. In such a case, the conductive fine particles may occupy a part of or the entirety of the conductive film 4.

Figure 2:
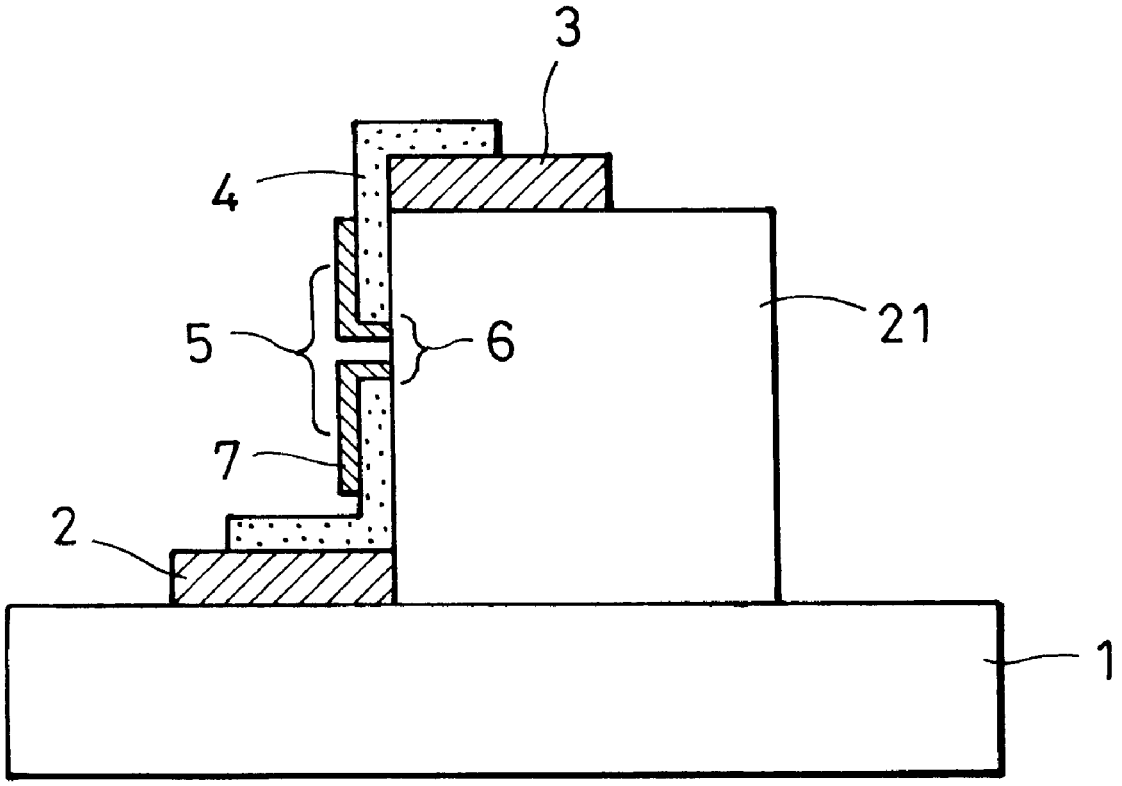
FIG. 2 is a schematic cross-sectional view of another embodiment of an electron emission device in accordance with the present invention.

An upright electron emission device will now be described. FIG. 2 is a schematic view of an upright electron emission device in accordance with the present invention. Parts having the same functions as in FIG. 1 are referred to with the same numerals. The device has a step section 21 which is composed of an insulating material such as $SiO_2$ and is formed by a vacuum deposition process, a printing process, or a sputtering process, in addition to a substrate 1, electrodes 2 and 3, a conductive film 4, a gap 6, a thin film 7, and an electron emitting section 5, these parts being composed of the same materials as those in the above-described planar electron emission device. The thickness of the step section 21 corresponds to the interval L between the electrodes 2 and 3 in the above-described planar electron emission device and lies in a range of several hundreds of nanometers to several tens of micrometers, and preferably several tens of nanometers to several micrometers in consideration of the method for making the step section 21 and the voltage applied between the electrodes 2 and 3.

Figure 3A:
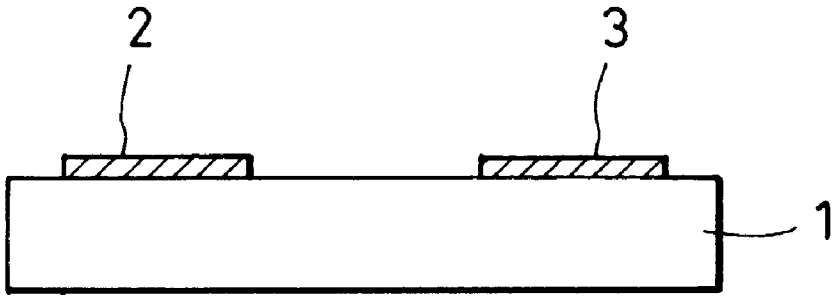
FIGS. 3A to 3C show steps of a method for making an electron emission device in accordance with the present invention.
Figure 3B:
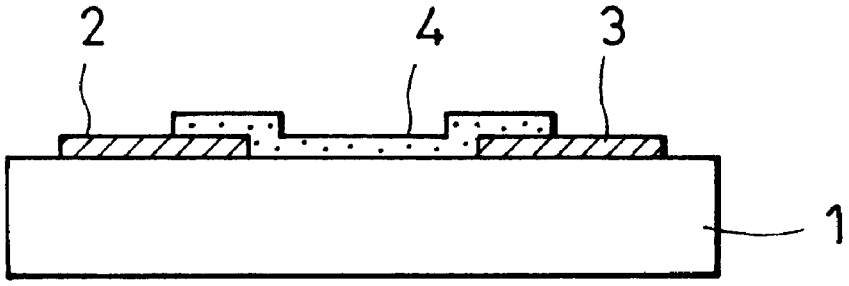
Figure 3C:
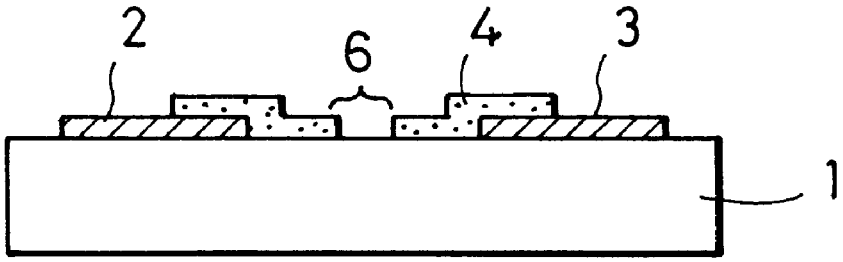

The electron emission device in accordance with the present invention may be produced by various methods. FIGS. 3A to 3C are cross-sectional views showing one of the methods. Parts having the same functions as in FIG. 1 are referred to with the same numerals.

1) With reference to FIG. 3A, a substrate 1 is thoroughly cleaned with a detergent, purified water and an organic solvent. An electrode material is deposited thereon by a vacuum deposition process or a sputtering process, and then patterned to form device electrode 2 and 3 by a photolithographic process.

2) With reference to FIG. 3B, an organometallic solution is applied onto the substrate 1 provided with the electrodes 2 and 3 to form an organometallic thin film. The organometallic solution contains an organometallic compound primarily composed of a metal used for the formation of the conductive film 4. The organometallic thin film is baked and then patterned by a lift-off or etching process to form a conductive film 4. Instead of the coating process, the conductive film 4 may also be formed by a vacuum deposition process, a sputtering process, a chemical vapor deposition process, a dispersion coating process, a dipping process or a spinning process.

3) With reference now to FIG. 3C, the substrate is subjected to an electrifying forming step to form a gap 6 such as a crack in the conductive film 4.

Figure 4A:
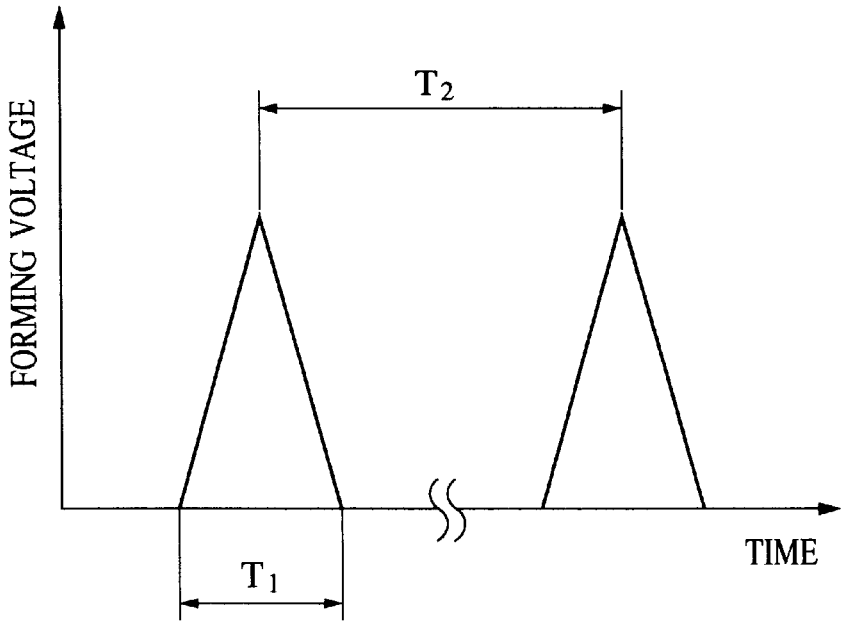
FIGS. 4A and 4B are graphs of voltage waveforms applied during electrifying forming in accordance with the present invention.
Figure 4B:
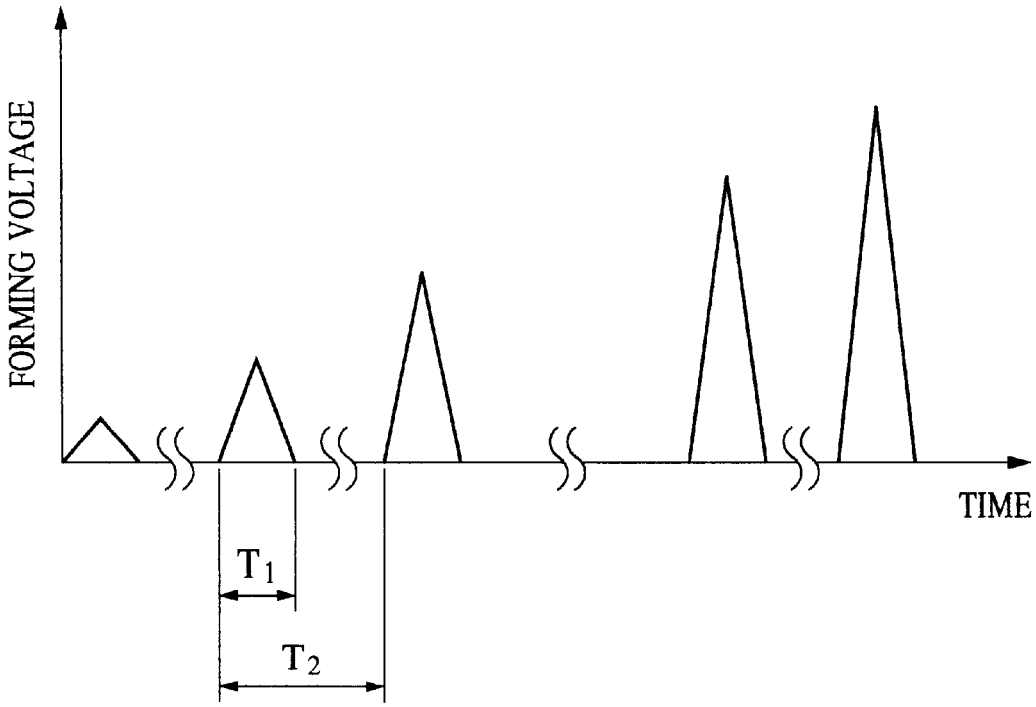

FIGS. 4A and 4B are graphs of waveforms of pulse voltages applied in the electrifying forming. As shown in FIGS. 4A and 4B, pulse voltages are preferable. In FIG. 4A, pulses having a constant voltage are continuously applied, whereas in FIG. 4B, pulses having gradually increasing voltages are continuously applied. In FIGS. 4A and 4B, $T_1$ represents the pulse width and $T_2$ represents the pulse interval.

In the method shown in FIG. 4A, the height of the triangular waves or the peak voltage is determined depending on type of the electron emission device. The pulses are generally applied for several seconds to several tens of minutes under such conditions. Any other pulse waves, for example, rectangular waves, other than triangular waves, may also be used. In the method shown in FIG. 4B, the height of the triangular waves is increased by, for example, 0.1 V for each pulse.

The electrifying forming treatment is performed before the conductive film 4 has a predetermined resistance. The resistance is measured as follows. A low voltage not causing local destruction or deformation is applied to the conductive film 4 during a pause time between the pulses, that is, the pulse interval $T_2$, and the conducted current is measured. For example, a voltage of approximately 0.1 volts is applied to detect the current in the conductive film 4. When the resistance reaches 1 MΩ or more, the electrifying forming treatment is completed.

The device after the forming treatment is preferably subjected to an activation step. The device current $I_f$ and the emission current $I_e$ significantly change during the activation step. In the activation step, pulses are repeatedly applied in an organic gas atmosphere as in the electrifying forming treatment. As shown in FIGS. 1A and 1B, carbon or carbonaceous materials derived from the organic substance are deposited on the conductive film 4. The resulting thin film 7 causes significant changes in the device current $I_f$ and the emission current $I_e$.

Herein, the term "carbon and/or a carbonaceous material" includes, for example, graphites and amorphous carbon. Examples of graphites include highly orientated pyrolytic graphite (HOPG), pyrolytic graphite (PG) and graphitizing carbon (GC). The HOPG has a crystal structure composed of substantially complete graphite, the PG has a slightly disordered crystal structure having a crystal grain size of approximately 200 angstroms, and the GC has a considerably disordered crystal structure having a crystal grain size of approximately 20 angstroms. The amorphous carbon includes mixtures of amorphous carbon and microcrystal graphite. The thickness of the carbon and/or the carbonaceous material is preferably 500 angstroms or less, and more preferably 300 angstroms or less.

Figure 5A:
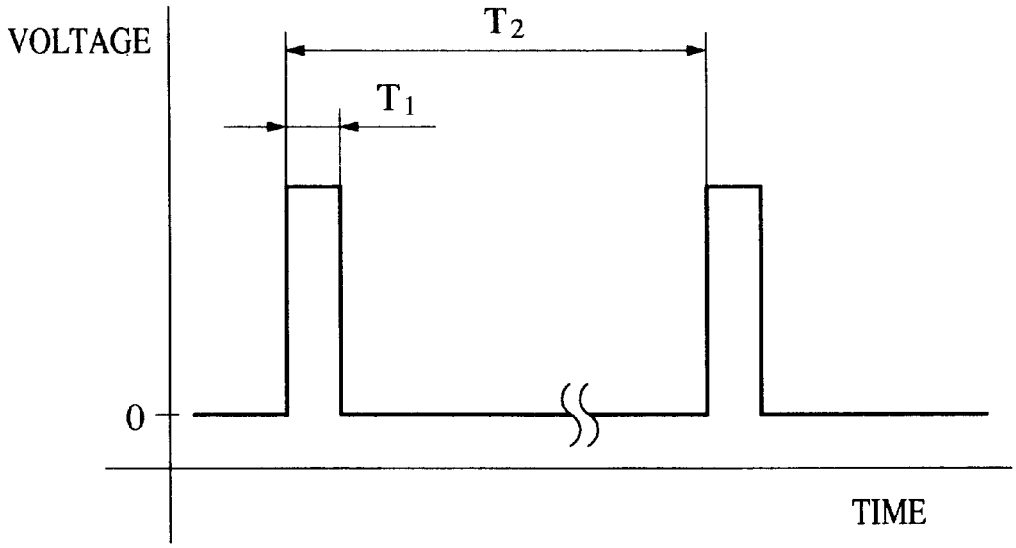
FIGS. 5A and 5B are graphs of voltage waveforms applied during an activation step in accordance with the present invention.
Figure 5B:
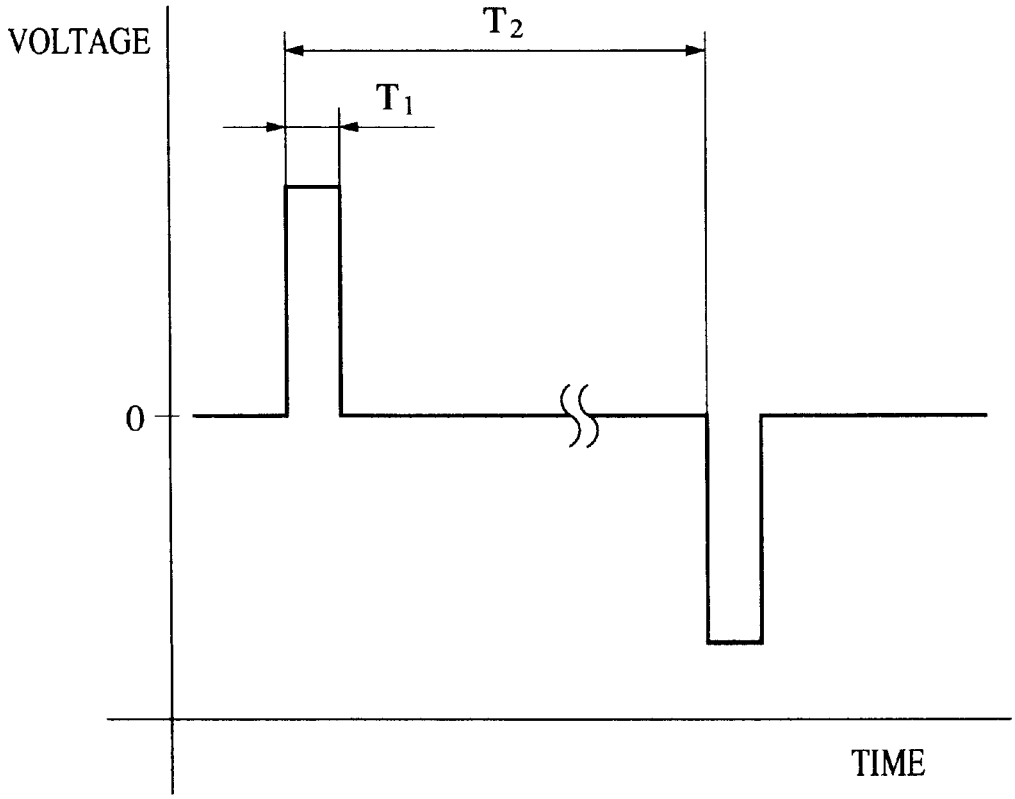

A voltage is applied in the activation step, while changing the voltage over time, the polarity of the applied voltage, or the waveform of the voltage. The voltage may be applied in a constant voltage mode or an increasing voltage mode, as in the forming treatment. The polarity of the applied voltage may be the same as that during a driving mode as shown in FIG. 5A, or may be alternatively changed as shown in FIG. 5B. The latter case is preferable since carbon films are symmetrically formed on both sides of the crack, as shown in FIGS. 1 and 2. In the former case, the volume of the deposited thin films 7 at the low potential side is smaller than the volume at the high potential side, although the device configuration is similar to that in the latter case. Any other pulse waves, for example, sinusoidal waves, triangular waves, rectangular waves, and sawtooth waves, other than rectangular waves, may also be used. The completion of the activation step is appropriately determined by measuring the device current $I_f$ and the emission current $I_e$.

In the activation step, the organic gas atmosphere is formed by introducing an organic gas into the vacuum system.

Figure 6:
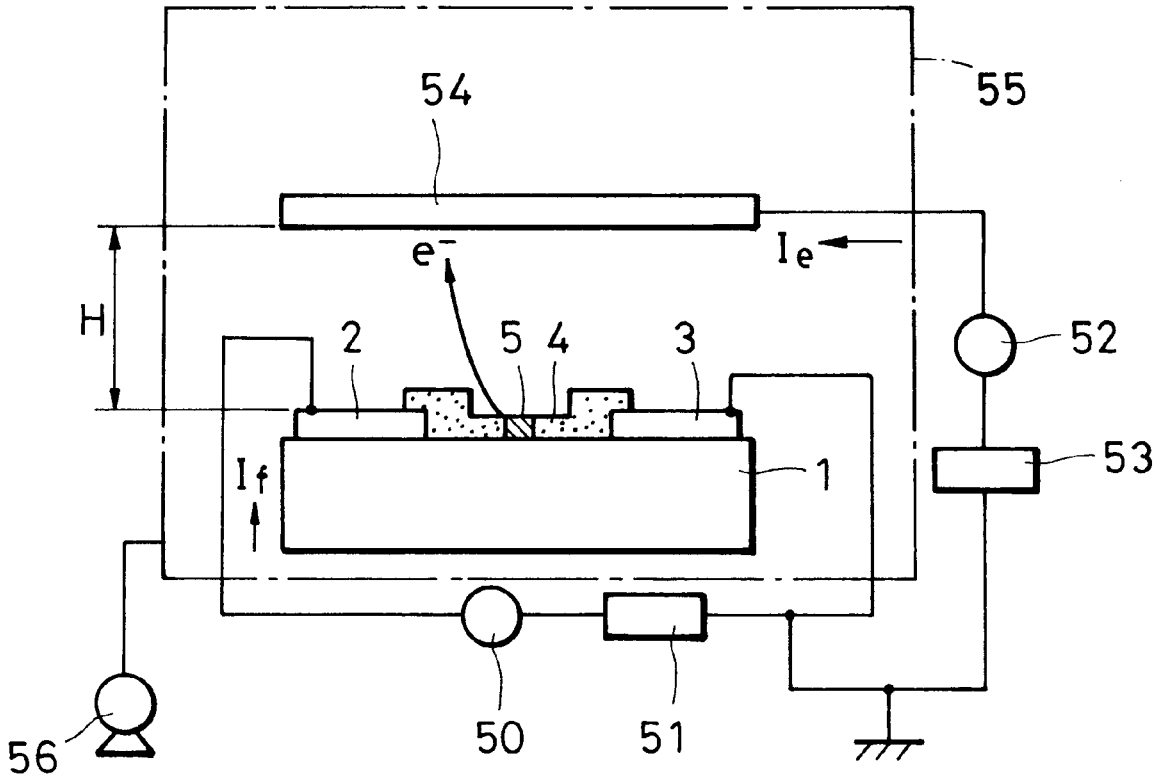
FIG. 6 is a schematic view of a testing apparatus for evaluating an electron emission device in accordance with the present invention.

FIG. 6 is a schematic view of a vacuum unit that also functions as a measuring unit, in which an electron emission device to be treated by an electrical process is connected to an electrical power source and the relevant parts in the vacuum unit. Parts having the same functions as in FIG. 1 are referred to with the same numerals. In FIG. 6, the vacuum unit has a vacuum chamber 55 and a vacuum system 56. An electron emission device is placed into the vacuum chamber 55. The vacuum unit further has an electrical power source 51 for applying a device voltage $V_f$ to the electron emission device, and an ammeter 50 for detecting the device current $I_f$ flowing in the conductive film 4 between electrodes 2 and 3, and an anode 54 for collecting the emission current $I_e$ from the electron emitting section 5. A voltage is applied to the anode 54 through a high-voltage electrical power source 53. An ammeter 52 detects the emission current $I_e$ from the electron emitting section 5. Measurement is performed, for example, at a voltage of the anode 54 of 1 kV to 10 kV, and a distance H between the anode 54 and the electron emission device of 2 to 8 mm.

The electron emission device and the anode 54 are placed in the vacuum chamber 55 which is provided with a pump for evacuating the vacuum chamber 55, and the electron emission device is evaluated under a required vacuum pressure. The vacuum system 56 is an oil-less vacuum system. For example, the vacuum system 56 is an ultrahigh vacuum system including an ion pump in addition to a conventional high vacuum system of a magnetic levitation-type turbopump and a dry pump. The vacuum system is further provided with a manometer and a mass filter-type gas analyzer (a quadrupole mass spectrometer), which are not shown in the drawing, in order to measure the pressure and to identify the gas in the vacuum system. The overall vacuum system and the device substrate can be heated by a heater not shown in the drawing.

The atmosphere in the activation step is prepared by introducing a desirable organic gas in the vacuum chamber which is preliminarily evacuated to a sufficiently high vacuum pressure by the magnetic levitation-type turbopump and the dry pump.

Figure 7:
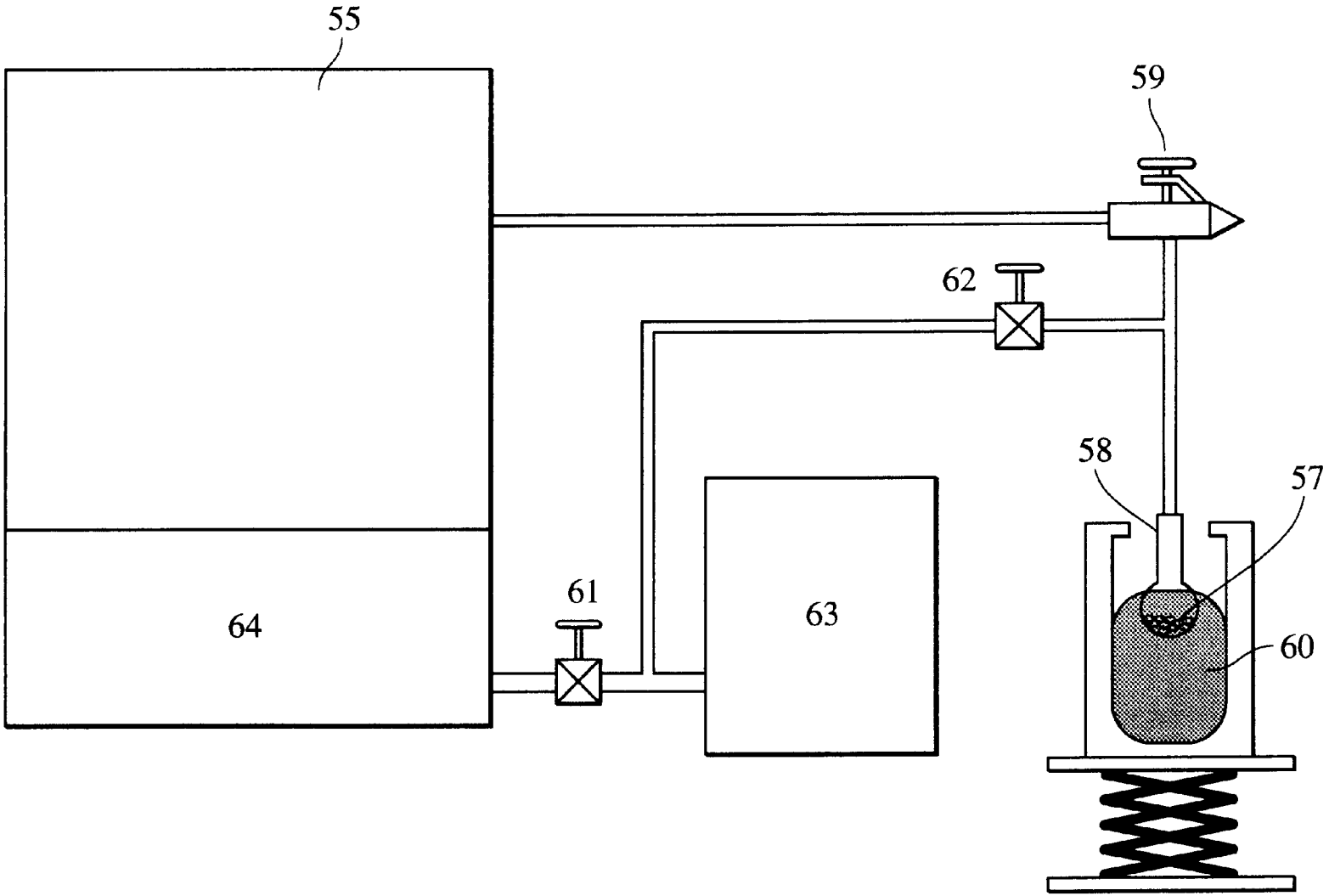
FIG. 7 is a schematic view of a vacuum treatment system used in an activation step in accordance with the present invention.

With reference to FIG. 7, the vacuum chamber 55 is connected to an ampoule 58 as a supply source of the organic substance 57. A gas cylinder can also be used as a supply source. The organic substance 57 in the supply source is introduced into the vacuum chamber 55 through a needle valve 59 as a flow controlling means to prepare an atmosphere for the activation step. A mass flow controller may be used instead of the needle valve 59. The pressure in the vacuum chamber is adjusted by the balance between the gas flow rate from the supply source and the evacuating rate of the vacuum pump. The gas flow rate from the supply source is controlled by the needle valve 59 (or the mass flow controller). The evacuating rate of the vacuum pump is controlled by a valve provided for adjusting the conductance between the vacuum pump and the vacuum chamber.

The preferable pressure of the organic gas substance is determined by the shape of the vacuum chamber, the type of the organic substance, and the like. In general, the preferable partial pressure of the organic gas is in a range of 1 Pa to $10^{-5}$ Pa.

In the present invention, any conventional organic substance can be used. Examples of organic gas materials include aliphatic hydrocarbons, such as alkanes, alkenes, and alkynes; aromatic hydrocarbons; alcohols; aldehydes; ketones; amines; organic acids, such as phenol, carboxylic acids, and sulfonic acids; and derivatives thereof. Examples of these compounds include methane, ethane, ethylene, acetylene, propylene, butadiene, n-hexane, 1-hexene, n-octane, n-decane, n-dodecane, benzene, toluene, o-xylene, benzonitrile, chloroethylene, trichloroethylene, methanol, ethanol, isopropyl alcohol, ethylene glycol, glycerin, formaldehyde, acetaldehyde, propanal, acetone, methyl ethyl ketone, diethyl ketone, methylamine, ethylamine, ethylene diamine, phenol, formic acid, acetic acid, and propionic acid.

In the activation step, the electron emitting characteristics of the electron emission device are determined by the concentration of the organic substance and the components other than the organic substance in the atmosphere in the vacuum chamber containing the device. For example, carbon and carbonaceous materials are more rapidly deposited when the concentration of the organic substance is high in the atmosphere. Thus, the deposit has a different volume or different crystallinity even if a voltage is applied between the electrodes for a fixed time. Accordingly, the electron-emitting device has different electron emitting characteristics.

Trace constituents, such as oxygen and water, in the atmosphere have an effect on the activation step. For example, the deposition of the carbon or carbonaceous materials is reduced, the activation requires a large initiation time, and the electron emitting characteristics by the activation are insufficient.

The atmosphere used in the activation step is generally formed by introducing an organic substance from a supply source into an apparatus which can be isolated from the external atmosphere. When the organic substance is liquid or solid, the vapor of the organic substance is introduced into the apparatus. Commercially available organic substances contain inert gas such as argon for ensuring stability of the substance in preservation. Furthermore, atmospheric gas components are contained in the organic substance, when the organic substance is fed into the supply source. The gas components in the organic substance cause unstable evaporation of the organic substance and unstable feeding from the supply source, and thus the concentration of the organic substance in the activation atmosphere changes over time. Furthermore, some dissolved gas components may have an effect on the deposition of carbon or carbonaceous materials. Accordingly, it is preferable that the impurities in the organic substance in the supply source be removed before the organic substance is fed into the vacuum chamber.

Examples of the impurities include atmospheric impurities, e.g., dust, water, nitrogen, and oxygen; isomers, such as racemic compounds; polymers such as dimers, oligomers; and reaction products. The type of the impurities highly depends on the chemical properties of the organic substances and the methods for making the substances.

The impurities in the organic substance may be removed by, for example, distillation or partial distillation by means of differences in boiling points; melting fractionation by means of differences in melting points; adsorption using an adsorbent including dehydration by a desiccating agent, filtration, and recrystallization. Other purification processes can also be employed in the present invention. The preferable purity of the organic substance is 99% or more.

When the organic substance used in the activation step is liquid or solid, the organic substance is generally gasified in the supply source and then introduced into the vacuum chamber. If the organic substance contains gaseous components or if impurities are contained in the dead space of the supply source, the partial pressure of the organic substance is decreased in the atmosphere. In particular, oxygen causes decreased electron emitting characteristics.

As described above, the feed rate of the organic substance into the vacuum chamber is controlled by a controlling means, such as a needle valve or a mass flow controller. Since a solid or liquid organic substance at room temperature generally has a low vapor pressure, which is lower than the pressure (1 kg/cm$^2$ or more) sufficient for operation of the mass flow controller. Thus, the feed rate is controlled by slight adjustment of the needle valve opening.

The conductance of the gas in the needle valve is proportional to the inverse number of the root of the molecular weight of the gas. When the organic substance contains impurities having lower molecular weights, the impurities predominantly pass through the needle valve. As a result, the activation atmosphere in the vacuum chamber contains concentrated impurities.

When the concentration of the impurities decreases during feeding for a long period, the flow rate of the organic substance relatively increases. Thus, the partial pressure of the organic substance will change in the vacuum chamber.

Since a solid or liquid organic substance at room temperature has a higher molecular weight and thus a lower vapor pressure than those of atmospheric components, such as nitrogen and oxygen, the atmospheric impurities have a significant effect on the activation step. The gas components dissolved in the organic substance may be removed by, for example, a freeze and thawing method. Any other process may also be employed in the present invention. The freeze and thawing method can effectively remove gas dissolved in the liquid, and particularly nitrogen and oxygen.

Oxygen deteriorates electron-emitting characteristics of the electron emission device in accordance with the present invention. Thus, when oxygen dissolved in the organic substance is removed by the freeze and thawing method, the activation step is effectively achieved.

Removal of nitrogen which is an atmospheric component ensures stability of feeding of the organic substance, and thus maintains a constant concentration of the organic substance in the vacuum chamber. Removal of atmospheric components is also effective for chemical stability of the organic substance in the supply source.

The impurity-free organic substance is introduced into the vacuum chamber, preferably without contact with atmospheric components. If the organic substance is contaminated by atmospheric components, such as oxygen and nitrogen, the activation is affected.

The isolation of the organic substance from the atmospheric components has the following advantages:

(1) The activation atmosphere does not contain substances, such as oxygen and water, which adversely affect the activation step.

(2) The purified organic substance is protected from inclusion of the atmospheric components.

The activated electron emission device is preferably subjected to a stabilization step. This step includes evacuation of the organic substance in the vacuum chamber. The vacuum unit for evacuating the vacuum chamber is preferably of an oil-less type. Examples of preferable vacuum units include a sorption pump and an ion pump.

It is preferable that the partial pressure of the organic component in the vacuum chamber be $1\times10^{-6}$ Torr or less, and more preferably $1\times10^{-8}$ Torr or less, so that the carbon and/or carbonaceous material do not further deposit in this step. It is preferable that the vacuum chamber be heated during the stabilization step so that organic molecules adsorbed in the inner wall of the vacuum chamber and in the electron emission device are easily removed and evacuated. Heating is performed at a temperature of 80 to 250° C., and preferably 150° C. or more for as long as possible. The heating conditions, however, may be changed without restriction depending on the size and shape of the vacuum chamber and the configuration of the electron emission device. The pressure in the vacuum chamber must be decreased as much as possible, and is preferably $1\times10^{-5}$ Torr or less, and more preferably $1\times10^{-6}$ Torr or less.

It is preferable that the atmosphere in the stabilizing step be maintained in a driving mode of the electron emission device. Sufficiently stable characteristics, however, can be achieved as long as the organic components are sufficiently removed even when the degree of the vacuum is slightly decreased. Since carbon or carbonaceous materials are not further deposited, the device current $I_f$ and the emission current $I_e$ can be stabilized.

Figure 8:
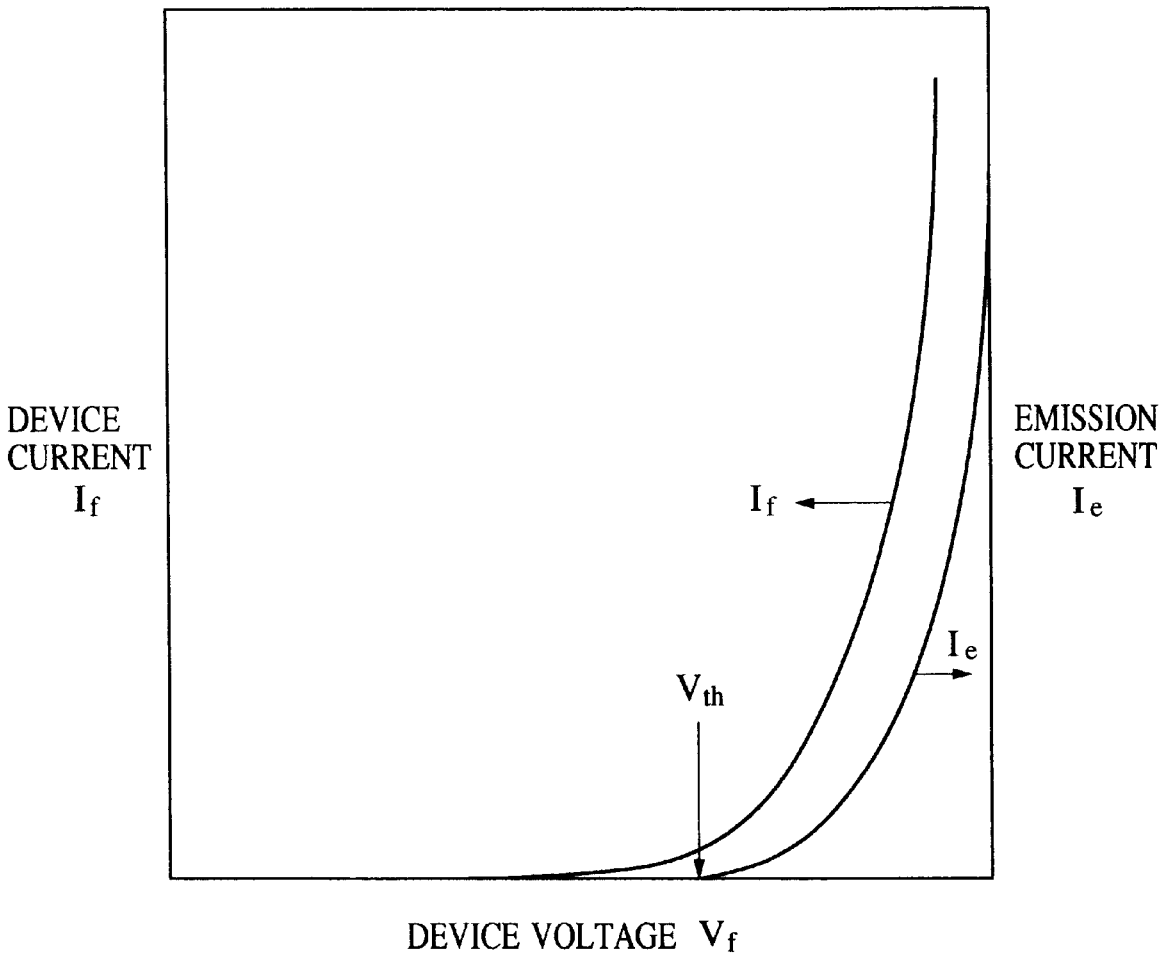
FIG. 8 is a graph showing the relationships of emission current $I_e$ and device current $I_f$ versus device voltage $V_f$ of an electron emission device in accordance with the present invention.

The basic characteristics of the electron emission device in accordance with the present invention will now be described with reference to FIG. 8. FIG. 8 is a schematic graph showing the relationship between the emission current $I_e$ or device current $I_f$ and the device voltage $V_f$ that are measured by the vacuum unit shown in FIGS. 6 and 7. Since the emission voltage $I_e$ is significantly smaller than the device voltage $I_f$, these voltages are expressed by arbitrary units in FIG. 8. The vertical axis and the horizontal axis are linear scales.

As shown in FIG. 8, the electron emission device in accordance with the present invention has the following three characteristics regarding the emission current $I_e$.

(1) The emission current $I_e$ steeply increases for an applied voltage higher than a threshold voltage $V_{th}$ (see FIG. 8), whereas the emission current $I_e$ is not substantially detected for a device voltage lower than the threshold voltage $V_{th}$. Thus, the device is of a nonlinear type having a distinct threshold voltage $V_{th}$ with respect to the emission current $I_e$.

(2) Since the emission current $I_e$ shows a monotonic increase as the device voltage $V_f$ increases, the device voltage $V_f$ can control the emission current $I_e$.

(3) The amount of charge collected in the anode 54 changes with the application time of the device voltage $V_f$. In other words, the application time of the device voltage $V_f$ controls the charge collected in the anode 54.

As described above, in the electron emission device in accordance with the present invention, electron-emitting characteristics can be readily controlled in response to the input signal. Such characteristics permit the application of the device in various fields, for example, an electron source and an image forming apparatus including an array of a plurality of electron emission devices. FIG. 8 shows a monotonic increase in the device current $I_f$ with respect to the device voltage $V_f$ (hereinafter referred to as an MI characteristic). Some devices have a voltage-controlled negative resistance characteristic (hereinafter referred to as a VCNR characteristic), although this is not shown in the drawings. The characteristics of the device can be determined by controlling the above-mentioned steps.

An image forming apparatus in accordance with the present invention can be produced by a combination of an electron source including an array of electron emission devices formed on a substrate with an image forming member which forms an image by irradiation of electrons from the electron source.

In an array of the electron emission devices, electron emission devices are arranged in a matrix in the X and Y directions, one of the electrodes of each electron emission device is connected to a common lead in the X direction, and the other electrode of each electron emission device is connected to a common lead in the Y direction. Such an arrangement is called a simple matrix arrangement.

A substrate for an electron source (or an electron source substrate) having a simple matrix arrangement of electron emission devices in accordance with the present invention will now be described with reference to FIG. 9. X-axis lead lines 72 including $D_{x1}$, $D_{x2}$, . . . , $D_{xm}$ (wherein m is a positive integer) are composed of a conductive material such as a metal and are formed on an electron source substrate 71 by a vacuum deposition, printing, or sputtering process. The material, thickness, and width of the lead lines can be appropriately determined depending on the application. Y-axis lead lines 73 including $D_{y1}$, $D_{y2}$, . . . , $D_{yn}$ (wherein n is a positive integer) are also formed as in the X-axis lead lines 72. The X-axis lead lines 72 are electrically isolated from the Y-axis lead lines 73 by an insulating interlayer (not shown in the drawing) provided therebetween. The insulating interlayer is composed of, for example, $SiO_2$, and formed by a vacuum deposition, printing, or sputtering process on a part or the entirety of the electron source substrate 71. The material and process for and the shape and thickness of the insulating interlayer are determined such that the insulating interlayer has durability to a potential difference between the X-axis lead lines 72 and the Y-axis lead lines 73. One end of each X-axis lead line 72 and one end of each Y-axis lead line 73 are extracted as external terminals. Each of electron emission devices 74 in a matrix (mxn) are connected to the corresponding X-axis lead line 72 and the corresponding Y-axis lead line 73 through a pair of electrodes (not shown in the drawing) provided on the two ends of the electron emission device 74 and a connecting line 75 composed of a conductive metal or the like.

The electron emission device 74 may be of a horizontal type or a vertical type. These lines 72, 73, and 75 and the electrodes may be composed of partially or substantially the same conductive material, or of different conductive materials.

The electron emission device made by the method in accordance with the present invention has the above-mentioned characteristics (1) to (3). That is, the emission current of the electron emission device is controlled by the height and width of the pulse voltage applied between the two electrodes when the voltage is higher than the threshold voltage. In contrast, electrons are not substantially emitted at a voltage which is lower than the threshold voltage. Also, in an array of electron emission devices, the emission current of each electron emission device is independently controlled in response to the pulse signal voltage which is applied to the electron emission device.

The Y-axis lead lines 73 are connected to a scanning signal application means (not shown in the drawing). The scanning signal application means applies scanning signals for selecting lines of the electron emission devices 74 arranged in the Y direction. The X-axis lead lines 72 are connected to a modulation signal application means (not shown in the drawing). The modulation signal application means applies modulation signals to the rows of the electron emission devices 74 arranged in the X direction in response to the input signals. A driving voltage applied to each electron emission device corresponds to a differential potential between the scanning signal and the modulation signal applied to the device.

In such a configuration, a simple matrix wiring system can independently drive individual electron emission devices. An image forming apparatus using an electron source having a simple matrix arrangement will be described with reference to FIGS. 10, 11A, 11B, and 12.

Figure 10:
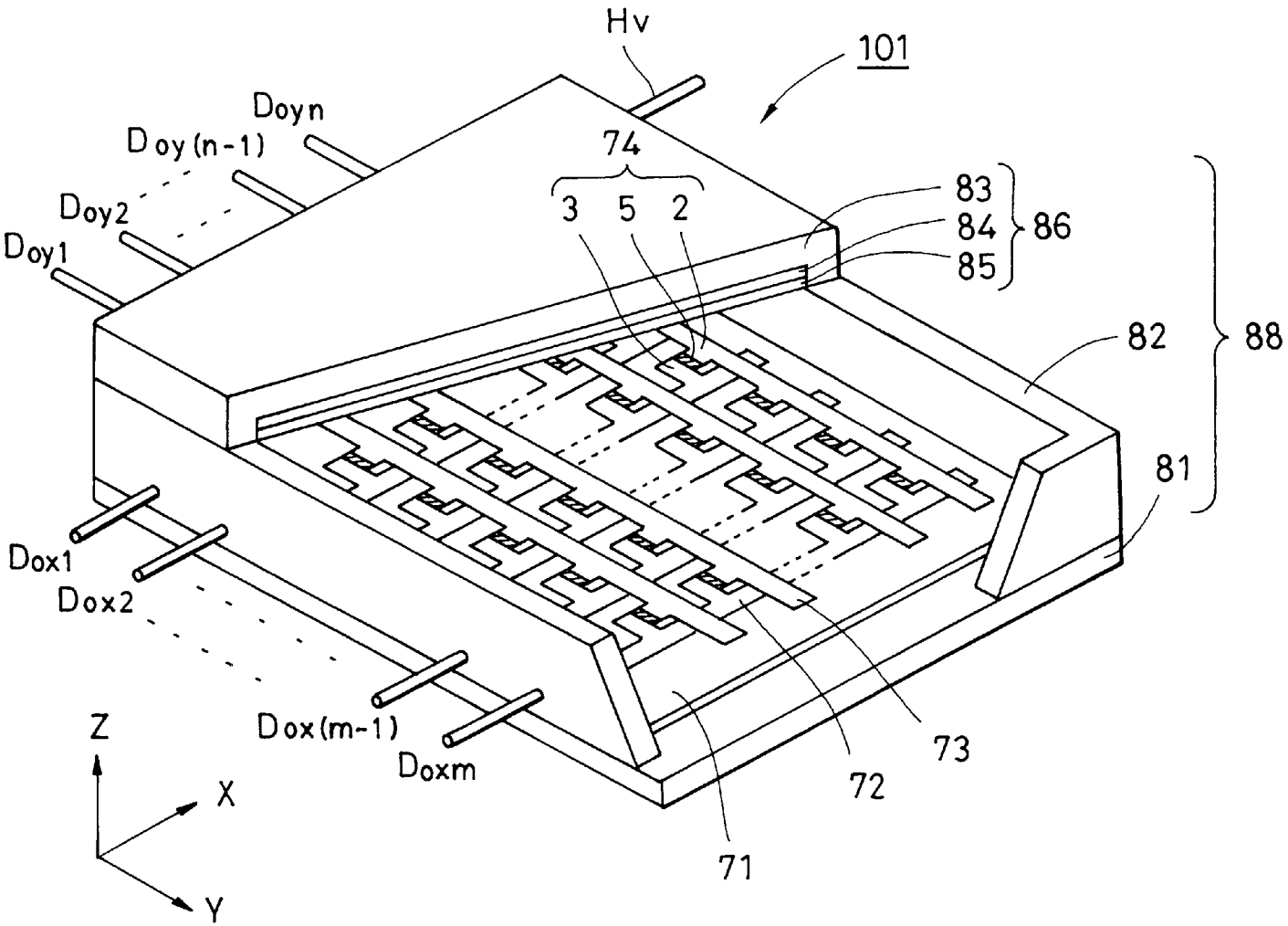
FIG. 10 is a schematic view of a display panel of an image forming apparatus in accordance with the present invention.

FIG. 10 is a schematic isometric view of a display panel of an image forming apparatus. With reference to FIG. 10, an electron source substrate as a rear plate 81 is provided with a matrix of electron emission devices 74 such as that shown in FIG. 1. An X-axis lead line 72 and a Y-axis lead line 73 are connected to a pair of electrodes in each electron emission device. Numeral 86 represents a face plate in which a fluorescent film 84 and a metal back layer 85 are formed on the inner face of a glass substrate 83. Numeral 82 represents a frame which is bonded to the rear plate 81 and the face plate 86 using frit glass having a low melting point.

An envelope 88 includes the face plate 86, the frame 82, and the rear plate 81. Since the rear plate 81 is provided for reinforcing the substrate 71, it can be omitted when the substrate 71 has sufficient strength. In such a case, the frame 82 is directly bonded to the substrate 71 so that the envelope 88 is composed of the face plate 86, the frame 82, and the substrate 71. When a support called a spacer (not shown in the drawing) is provided, the envelope 88 has sufficient strength at atmospheric pressure.

Figure 11A:
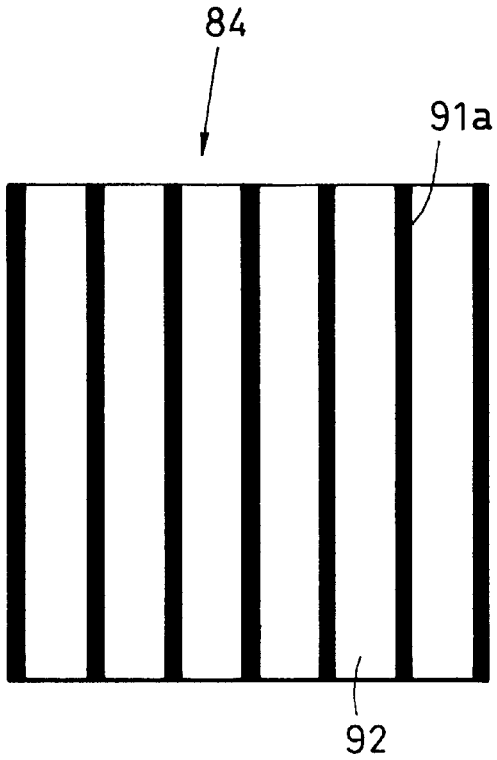
FIGS. 11A and 11B are schematic views of fluorescent films.
Figure 11B:
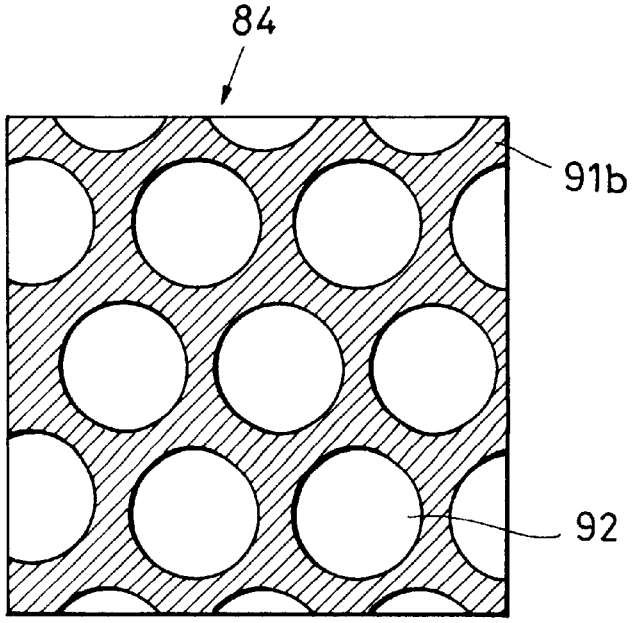

FIGS. 11A and 11B are schematic views of fluorescent films. A monochrome fluorescent film may comprise only a fluorescent substance. A colored fluorescent film may comprise conductive black stripes 91*a* (in FIG. 11A) or a conductive black matrix 91*b* (in FIG. 11B) and fluorescent substances 92 depending on the arrangement of the fluorescent substances. The black stripe or matrix prevents mixing between adjacent fluorescent substances 92 corresponding to three primary colors and suppression of the contrast due to reflection of external light by the fluorescent film. The material for the black stripe or matrix contains graphite as a main component and a conductive component having low light transmittance and reflection.

With reference to FIG. 10, the monochrome or color fluorescent substance may be applied onto the glass substrate 83 to form the fluorescent film 84 by a precipitation or printing process. The metal back layer 85 is generally provided on the inner face of the fluorescent film 84. The metal back layer 85 acts as a mirror reflecting light emitted from the fluorescent substance towards the face plate 86 and thus improves luminance. Also, the metal back layer 85 functions as an electrode for applying an electron beam acceleration voltage and protects the fluorescent substance from damage due to collision of negative ions occurring in the package. The metal back layer 85 is generally formed by depositing aluminum by a vacuum deposition process onto the inner surface of the fluorescent film 84 after performing a smoothing treatment (generally called "filming") of the inner surface.

The face plate 86 may be provided with a transparent electrode (not shown in the drawing) at the outer face of the fluorescent film 84 in order to enhance conductivity of the fluorescent film 84.

In a color system, color fluorescent substances and electron emission devices must be exactly aligned before sealing.

Figure 15:
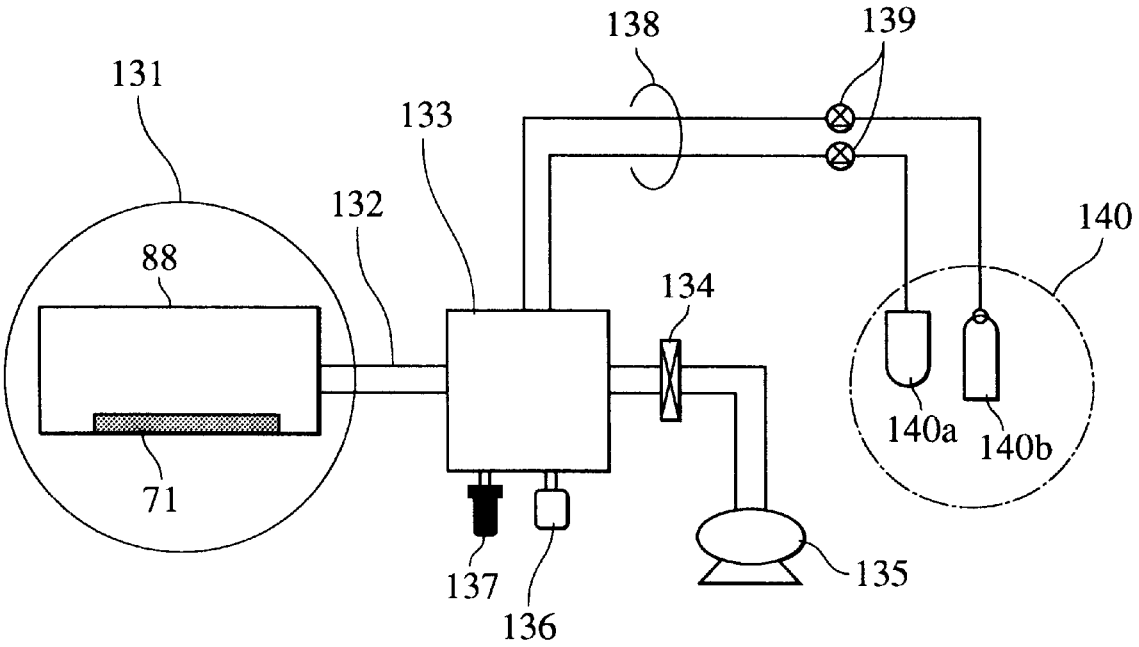
FIG. 15 is a schematic view of a vacuum system used in an activation step in accordance with the present invention.

The image forming apparatus shown in FIG. 10 is produced as follows. FIG. 15 is a schematic view of an apparatus used in the process. An image forming apparatus 131 is connected to a vacuum chamber 133 through an exhaust tube 132, and to a vacuum system 135 through a gate valve 134. The vacuum chamber 133 has a manometer 136 and a quadrupole mass spectrometer 137, which determine the internal pressure and the partial pressure of the components in the atmosphere. Since it is difficult to directly measure the internal pressure of the envelope 88 of the image forming apparatus 131, the internal pressure of the vacuum chamber is measured to control the treating conditions. The vacuum chamber 133 is connected to gas inlet lines 138 which feed gas required for controlling the atmosphere into the vacuum chamber. The other ends of the gas inlet lines 138 are connected to a supply source 140 for materials to be introduced. The materials are reserved in an ampoule 140*a* and a cylinder 140*b*. Feed controlling means 139 are provided in the gas inlet lines 138 to control the feed rate of the materials. As the feed controlling means 139, valves which can control the flow rate of the leaked gas, such as a slow leak valve, and a mass flow controller can be used according to the type of the materials.

Figure 16:
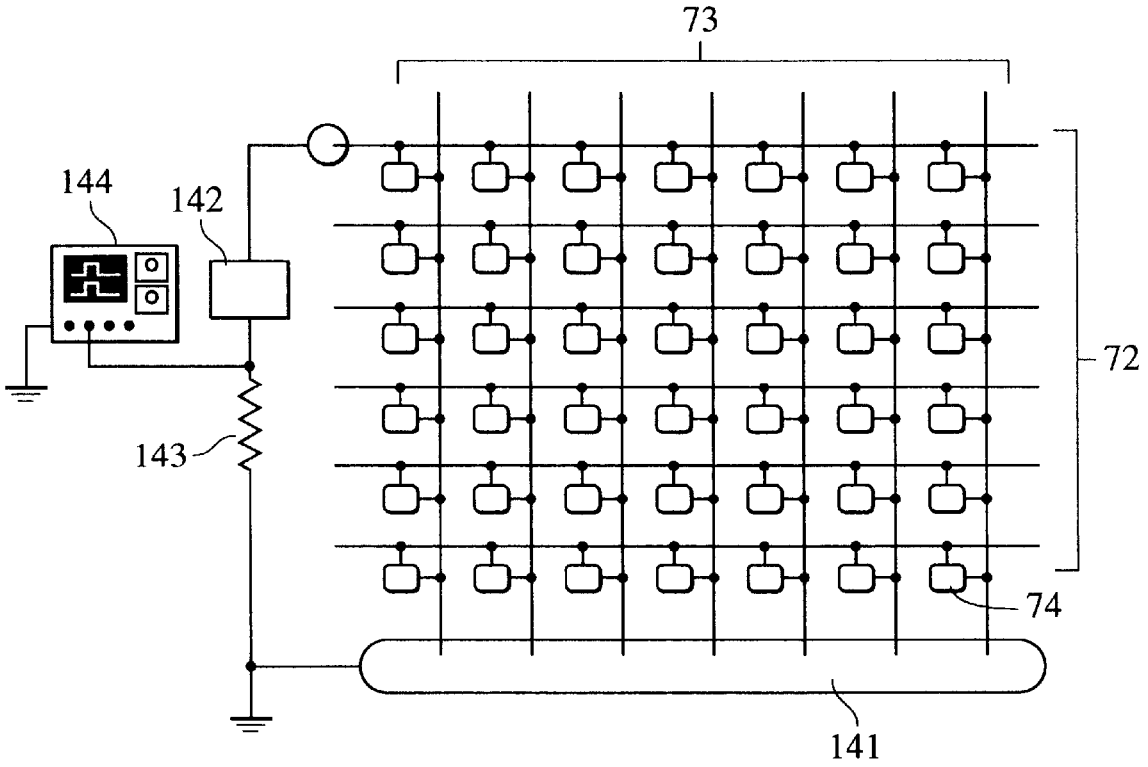
FIG. 16 is a schematic diagram of a connection for forming and activation in accordance with the present invention.

The interior of the envelope 88 is evacuated and subjected to forming treatment using the apparatus shown in FIG. 15. With reference to FIG. 16, the Y-axis lead lines 73 are connected to a common electrode 141, and a pulse voltage is applied to devices connected to one of the X axis lead lines 72 from an electrical power source 142 for simultaneously forming these devices. The forming conditions, such as the pulse shape and the completion of the treatment, are determined according to the above-described method for a single device. Pulses having different phases may be sequentially applied to Y-axis lead lines (by scrolling) so that devices connected to the Y-axis lead lines are simultaneously subjected to forming process. In the drawing, numeral 143 and numeral 144 represent a resistance and an oscilloscope, respectively, used for measuring the current.

The forming step is followed by the activation step. The envelope 88 is thoroughly evacuated, and then the gas of a deaerated organic substance is introduced from the supply source through the gas inlet lines 138. When a voltage is applied to each electron emission device in the organic atmosphere, carbon and/or carbonaceous materials are deposited on the electron emission device, as described above.

The electron emission devices are preferably subjected to a stabilizing step, as in the above-described single electron emission device. The envelope 88 is heated and evacuated through the exhaust tube 132 using an oil-less vacuum unit, such as an ion pump or a sorption pump while maintaining the temperature at 80° C. to 250° C. After the envelope 88 is thoroughly evacuated, the exhaust tube 132 is sealed off using a burner. The envelope 88 may be subjected to getter treatment in order to maintain the pressure of the sealed envelope. In the getter treatment, a getter (not shown in the drawings) provided at a given position in the envelope 88 is heated immediately before or after the sealing of the envelope 88 to form a deposited film by evaporation. The getter is generally composed of barium, and the deposited film has adsorption effects such that the atmosphere in the envelope 88 is maintained.

Figure 12:
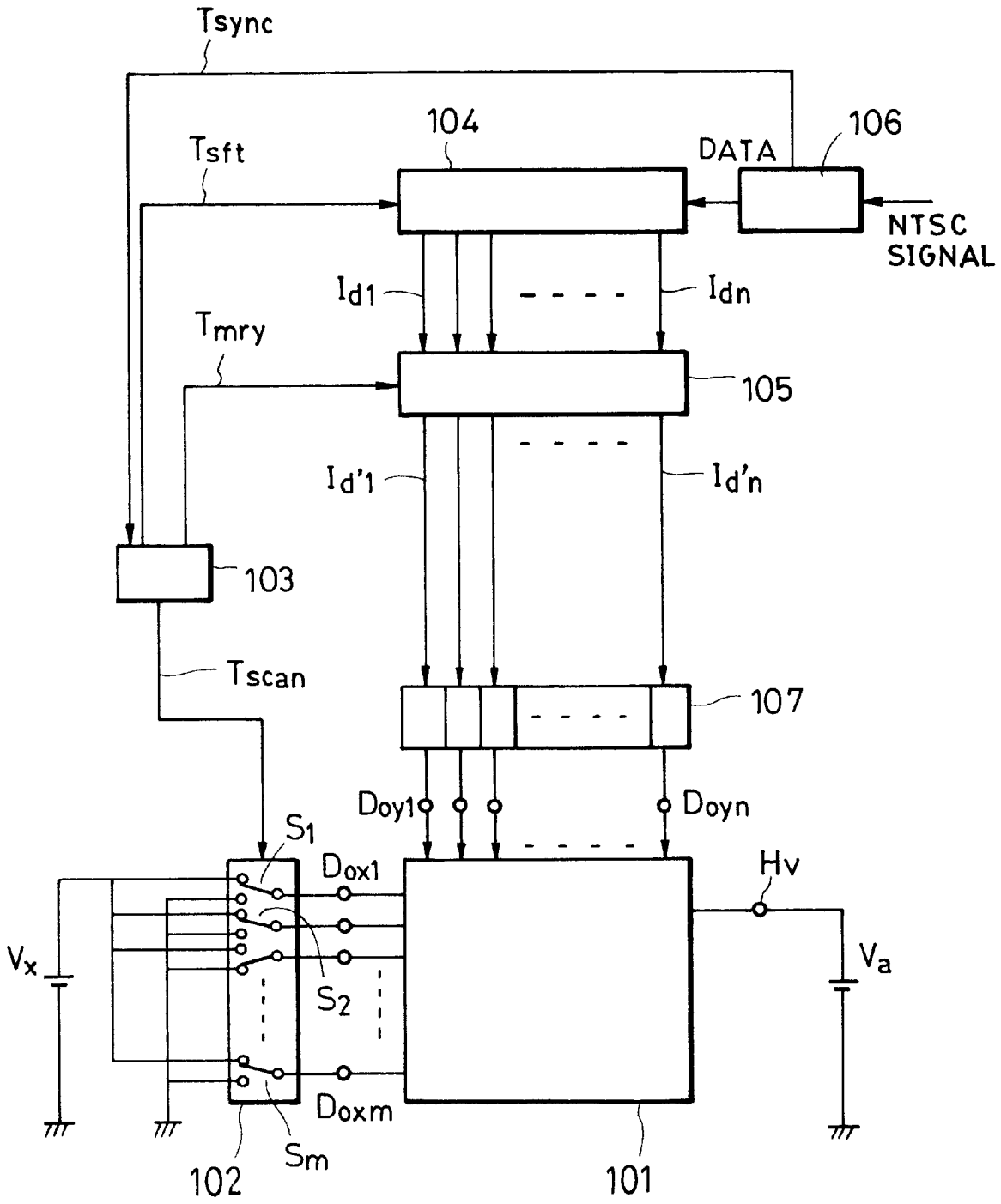
FIG. 12 is a block diagram of a driving circuit for performing display in an image forming apparatus in response to NTSC television signals.

FIG. 12 is a block diagram of a driving circuit for an NTSC television display having a display panel including an electron source having a simple matrix arrangement. The circuit diagram includes an image display panel 101, a scanning circuit 102, a control circuit 103, a shift register 104, a line memory 105, a synchronous separation circuit 106, a modulation signal generator 107, and DC voltage sources $V_x$ and $V_a$.

The display panel 101 is connected to an external electrical circuit through terminals $D_{ox1}$ to $D_{oxm}$ and $D_{oy1}$ to $D_{oyn}$ and a high voltage terminal Hv. Scanning signals are applied to the terminals $D_{ox1}$ to $D_{oxm}$ for driving the electron source provided in the display panel 101, that is, for driving each line (including n devices) sequentially of a matrix (mxn) of surface conductive type electron emission devices. Modulation signals are applied to the terminals $D_{oy1}$ to $D_{oyn}$ for controlling the intensity of the electron beam output from each electron emission device. A DC voltage of, for example, 10 kV is applied to the high-voltage terminal Hv through the DC voltage source $V_a$. The DC voltage corresponds to an acceleration voltage that accelerates the electron beams emitted from the electron emission devices to a level capable of exciting the fluorescent substance.

The scanning circuit 102 has m switching elements $S_1$ to $S_m$ therein, as shown schematically in the drawing. Each switching element selects either an output voltage from the DC voltage source $V_x$ or a ground level (0 volts), and the switching elements $S_1$ to $S_m$ are connected to the terminals $D_{ox1}$ to $D_{oxm}$, respectively, in the display panel 101. The switching elements $S_1$ to $S_m$ operate based on the control signals $T_{scan}$ output from the control circuit 103. Each switching element includes, for example, an FET. The DC voltage source $V_x$ outputs a constant voltage so that the driving voltage applied to the unscanned devices, on the basis of the characteristics of the electron emission device, is lower than the threshold voltage of electron emission.

The control circuit 103 controls matching of individual units so that a desired display is achieved based on external image signals. The control circuit 103 generates control signals $T_{scan}$, $T_{sft}$, and $T_{mry}$ in response to synchronous signals $T_{sync}$ sent from the synchronous separation circuit 106. The synchronous separation circuit 106 includes a typical frequency separation circuit (filter), and separates the external NTSC television signals into synchronous signal components and luminance signal components. The synchronous signal components include vertical synchronous signals and horizontal synchronous signals, and are represented by "$T_{sync}$" in the present invention. The luminance signal components are represented by "DATA signal". The DATA signals enter the shift register 104.

The shift register 104 serial-to-parallel-converts the DATA signals input in time series corresponding to each line of the image, and operates in response to the control signal $T_{sft}$ from the control circuit 103. In other words, the control signal $T_{sft}$ functions as a shift clock for the shift register 104. The serial-to-parallel-converted data corresponding to one line of the image is output as n parallel signals $I_{d1}$ to $I_{dn}$ from the shift register 104 to drive n electron emission devices.

The line memory 105 temporally stores n data $I_{d1}$ to $I_{dn}$ corresponding to one line of the image under the control of the control signal $T_{mry}$ sent from the control circuit 103. The stored data is output as $I_{d'1}$ to $I_{d'n}$ to the modulation signal generator 107.

The modulation signal generator 107 produces output signals for driving the electron emission devices in response to the image data $I_{d'1}$ to $I_{d'n}$, and the output signals are applied to the electron emission devices in the display panel 101 through the terminals $D_{oy1}$ to $D_{own}$.

As described above, the electron emission device in accordance with the present invention has the following fundamental characteristics with respect to the emission current $I_e$. Electron emission occurs when a voltage larger than the threshold voltage $V_{th}$ is applied to the device, and the emission current, that is, the intensity of the electron beams, varies monotonically with voltages higher than the threshold voltage $V_{th}$. Electron emission does not occur at an applied voltage lower than the threshold voltage $V_{th}$. When a pulse voltage higher than the threshold voltage $V_{th}$ is applied, the intensity of the emitted electron beams is controlled by the pulse height $V_m$. The total amount of the electron beams is also controlled by the pulse width $P_w$.

Examples of modulation systems for the electron emission devices in response to the input signals include a voltage modulation system and a pulse width modulation system. The voltage modulation system uses the modulation signal generator 107 including a voltage modulation circuit that modulates the height of the voltage pulse having a predetermined length in response to the input data. The pulse width modulation system uses the modulation signal generator 107 including a pulse width modulation circuit that modulates the width of the voltage pulse having a predetermined height in response to the input data.

The shift register 104 and the line memory 105 may be of digital signal types or analog signal types, as long as serial-to-parallel conversion of the image signals is performed within a predetermined time. When a digital signal type shift register 104 and line memory 105 are used, the output signal DATA from the synchronous separation circuit 106 must be digitized using an A/D converter provided at the output section of the synchronous separation circuit 106. The circuit in the modulation signal generator 107 is partially different between the digital signals and analog signals from the line memory 105. For example, in a voltage modulation system by digital signals, the modulation signal generator 107 has a D/A conversion circuit and an amplification circuit, if necessary. In a pulse width modulation system, the modulation signal generator 107 has a high-speed oscillator, a counter for counting the wave number output from the oscillator, and a comparator for comparing the output value from the counter with the output value from the memory. The modulation signal generator 107 may have an amplifier for voltage-amplifying the pulse width modulated signals from the comparator up to a driving voltage of the surface conductive type electron emission device.

In the voltage modulation system by analog signals, the modulation signal generator 107 has an operational amplifier, and a level shift circuit, if necessary. In the pulse width modulation system, the modulation signal generator 107 has a voltage-controlled oscillator (VCO), and an amplifier, if necessary, for voltage-amplifying the pulse width modulated signals up to a driving voltage of the surface conductive type electron emission device.

In such an image forming apparatus in accordance with the present invention, each electron emission device emits electron beams in response to the voltage applied to the device through the external terminals $D_{ox1}$ to $D_{oxm}$ and $D_{oy1}$ to $D_{oyn}$. The electron beams are accelerated by a high voltage applied to the metal back layer 85 or a transparent electrode (not shown in the drawing) through the high-voltage terminal Hv. The accelerated electron beams collide with the fluorescent film 84 to form a fluorescent image.

A variety of modifications in the configuration of the image forming apparatus are available within the technical concept of the present invention. For example, the input signal may be of a PAL system, a SECAM system, or a high-definition TV system, such as a MUSE system, having a larger number of scanning lines.

Figure 13:
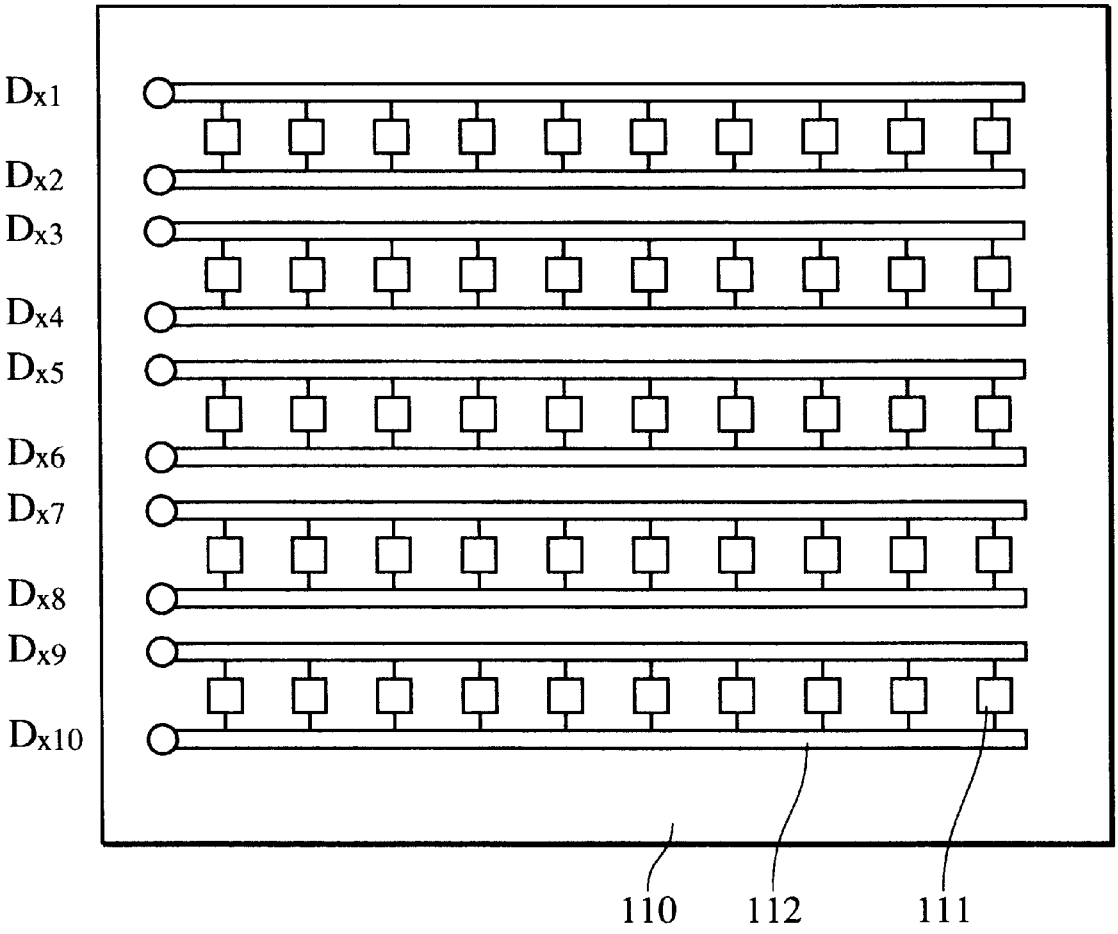
FIG. 13 is a schematic diagram of a ladder-type electron source in accordance with the present invention.

Next, a ladder type electron source and image forming apparatus will be described with reference to FIGS. 13 and 14. FIG. 13 is a schematic view of a ladder type electron source. The electron source includes an electron source substrate 110, electron emission devices 111 arranged on the electron source substrate 110, and common lead lines 112 ($D_{x1}$ to $D_{x10}$) connected to the electron emission devices 111. The electron emission devices 111 are arranged in series in the horizontal (X-axis) direction to form a plurality of device lines. Thus, the electron source comprises a plurality of horizontal device lines. Each device line is independently driven by a driving voltage applied to the two common lead lines connected to the device line. In other words, a voltage higher than the threshold voltage for electron emission is applied to lines that require emission of electron beams, whereas a voltage lower than the threshold voltage is applied to the other lines that do not require emission of electron beams. Among the common lead lines $D_{x2}$ to $D_{x9}$ disposed between the device lines, for example, lead lines $D_{x2}$ and $D_{x3}$ may be replaced with a common lead line.

Figure 14:
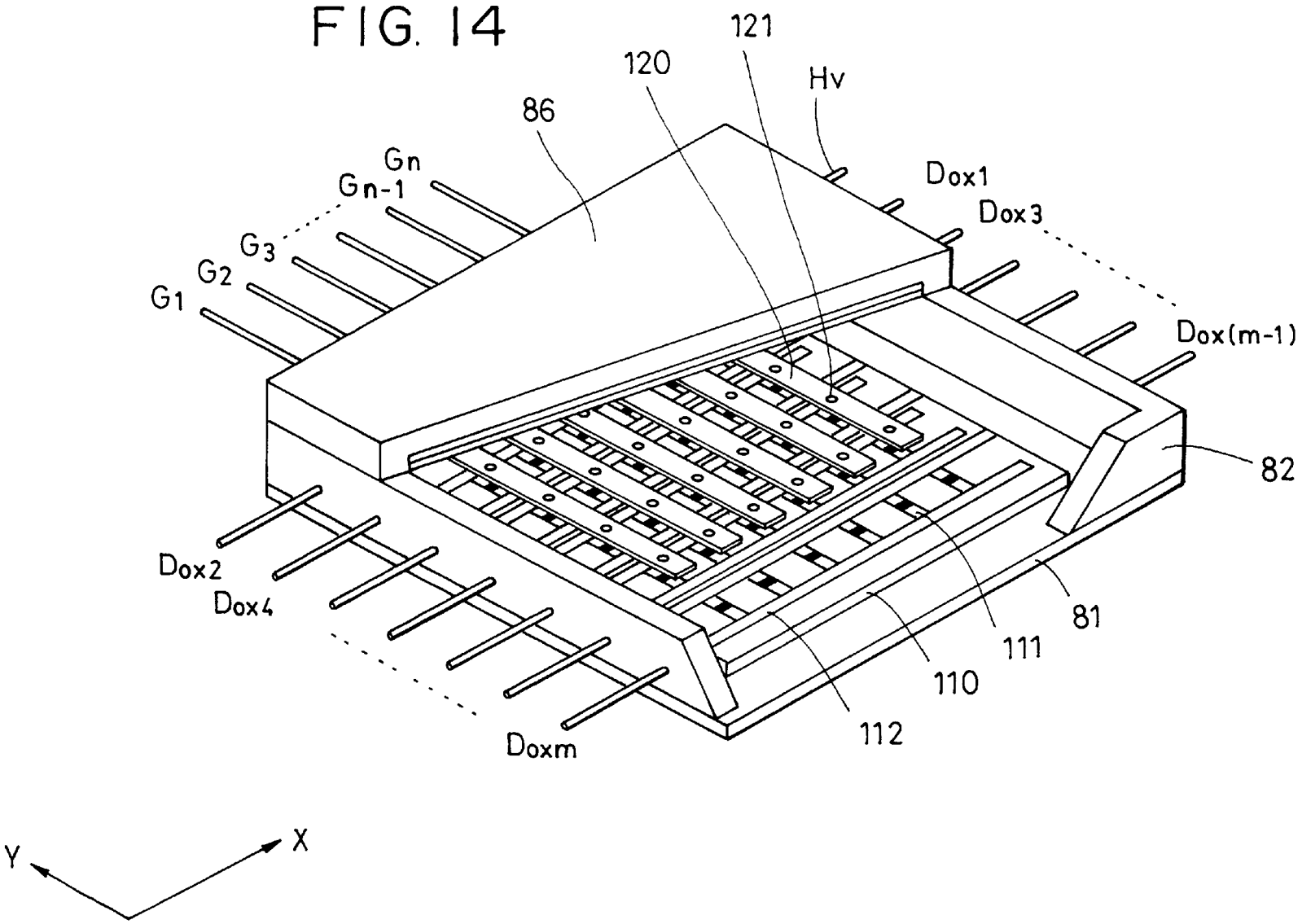
FIG. 14 is a schematic view of a display panel of an image forming apparatus in accordance with the present invention.

FIG. 14 is a schematic view of a panel of an image forming apparatus provided with the ladder type electron source, wherein numeral 120 represents grid electrodes, and numeral 121 represents openings which allow the transit of electrons. The image forming apparatus also has external terminals $D_{ox1}, D_{ox2}, \ldots, D_{oxm}$, external grid terminals $G_1, G_2, \ldots, G_n$ connected to the grid electrodes 120, and an electron source substrate 110 provided with a single common electrode for electron emission devices. Parts having the same functions as in FIGS. 10 and 13 are referred to with the same numerals. The image forming apparatus shown in FIG. 14 is fundamentally different from the simple matrix image forming apparatus shown in FIG. 10 in that the former has the grid electrodes 120 between the electron source substrate 110 and the face plate 86. The grid electrodes 120 modulate the electron beams emitted from the electron emission devices 111. Each grid electrode 120 has circular openings 121. The number of the openings 121 is equal to the number of devices. Electron beams pass through the openings 121 towards strip electrodes provided perpendicular to the ladder type device lines. The shape and position of the grids are not limited to those shown in FIG. 14. For example, the grids may comprise a mesh having many openings or passages. The grids may be arranged at the peripheries of, or in the vicinity of, the electron emission devices.

The external terminals $D_{ox1}, D_{ox2}, \ldots, D_{oxm}$ and external grid terminals $G_1, G_2, \ldots, G_n$ are connected to a control circuit (not shown in the drawing). In the image forming apparatus in this embodiment, each device line is driven or scanned in series while a series of modulation signals corresponding to one line of the image are synchronously applied to the corresponding grid electrode rows. The fluorescent substance is irradiated with the emitted electron beams to cause fluorescence with various luminances corresponding to one line of the image.

The image forming apparatus in accordance with the present invention can be applied to display devices for television broadcasting, television conferencing, and computer systems, and to optical printers provided with photosensitive drums.

EXAMPLES

The present invention will now be described in more detail with reference to the following examples. It is our intention that the invention not be limited by any of these examples, and it is believed obvious that modification and variation of our invention is possible in light of the examples.

Example 1

An electron emission device in accordance with Example 1 has a configuration shown in FIG. 1. A method for making the electron emission device is described with reference to FIGS. 17A to 17E, 18F to 18J, and 19K to 19O.

Figure 17A:
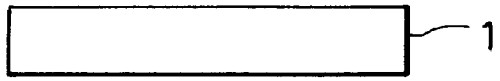
FIGS. 17A to 17E, 18F to 18J and 19K to 19O are cross-sectional views of steps in a production process of an electron emission device in accordance with the present invention.
Figure 17B:
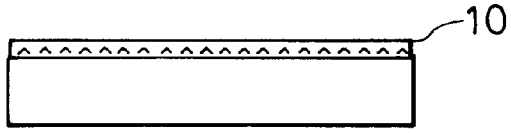
Figure 17C:
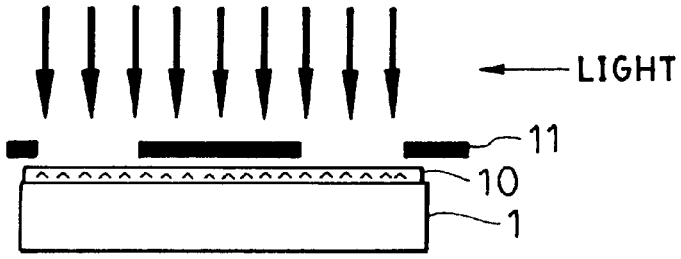
Figure 17D:
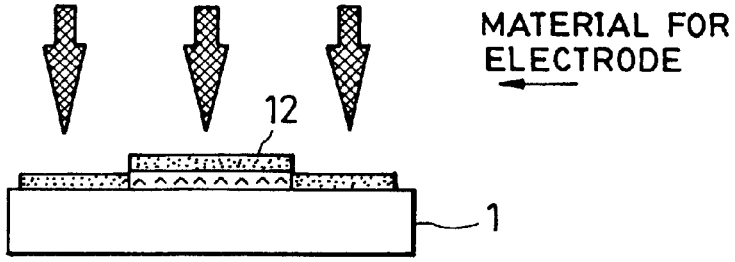
Figure 17E:
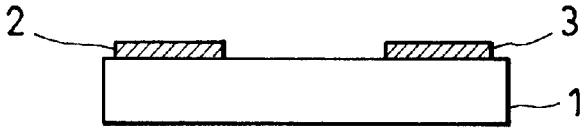

Step 1) With reference to FIG. 17A, a quartz substrate as in insulating substrate 1 was thoroughly cleaned with a detergent, deionized water, and an organic solvent. With reference to FIG. 17B, a resist 10 (RD-2000N made by Hitachi Chemical Co., Ltd.) was coated on the insulating substrate 1 by a spin coating process at 2,500 rpm for 40 seconds, and was then preliminarily baked at 80° C. for 25 minutes. With reference to FIG. 17C, a mask 11 having an electrode pattern with an interelectrode distance L of 2 $\mu$m and an electrode width W of 500 $\mu$m, as shown in FIG. 1, was brought into contact with the resist 10. The resist 10 was exposed through the mask 11 and developed with an exclusive developing solution for RD-2000N. The insulating substrate 1 was heated to 120° C. for 20 minutes for post baking. With reference to FIG. 17D, a nickel film 12 with a thickness of 100 nm was deposited thereon at a deposition rate of 0.3 nm/sec in a resistance heating evaporation system. With reference to FIG. 17E, the residual resist 10 with the nickel film 12 formed thereon was removed with acetone by a lift-off technique, and the insulating substrate 1 was cleaned with acetone, isopropyl alcohol, and then butyl acetate, and then dried. Two electrodes 2 and 3 were thereby formed on the insulating substrate 1, as shown in FIG. 17E.

Figure 18F:
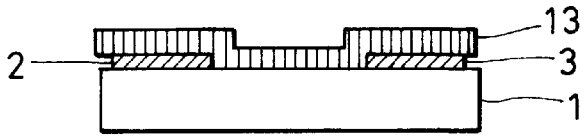
Figure 18G:
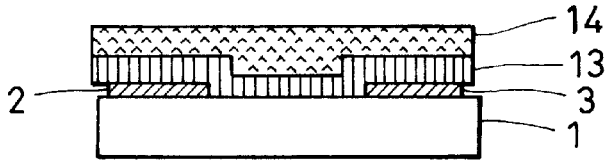
Figure 18H:
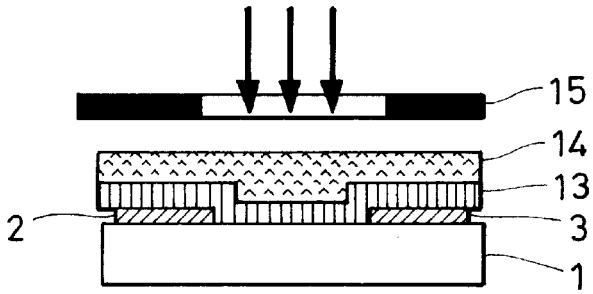
Figure 18I:
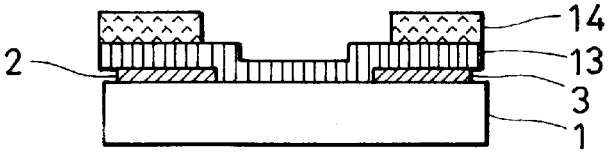
Figure 18J:
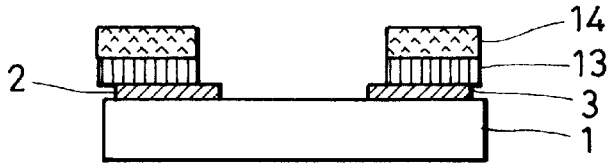
Figure 19K:
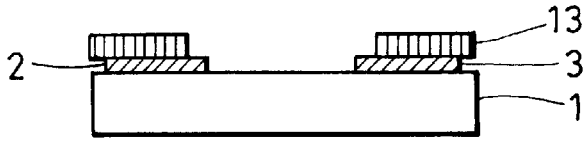

Step 2) With reference to FIG. 18F, a chromium film 13 with a thickness of 50 nm was formed on the entire substrate by a vapor evaporation process. With reference to FIG. 18G, a resist 14 (AZ1370 made by Hoechst AG) was coated thereon by a spin coating process at 2,500 rpm for 30 seconds, and was then preliminarily baked at 90° C. for 30 minutes. With reference to FIG. 18H, the resist 14 was exposed through a mask 15 having a conductive film pattern. With reference to FIG. 18I, the resist 14 was developed with a developing solution MIF312. With reference to FIG. 18J, the chromium film 13 was etched by dipping the substrate in a solution containing 17 g of $(NH_4)Ce(NO_3)_6$, 5 ml of $HClO_4$ and 100 ml of $H_2O$ for 30 seconds. With reference to FIG. 19K, the substrate was agitated by ultrasonic waves in acetone for 10 minutes to remove the resist.

Figure 19L:
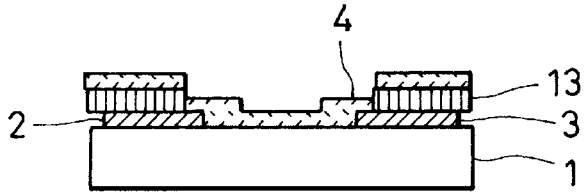

With reference to FIG. 19L, an organic palladium compound (ccp4230 made by Okuno Chemical Industries, Co., Ltd.) was coated thereon by a spin coating process at 800 rpm for 30 seconds, and was then baked at 300° C. for 10 minutes to form a particulate conductive film 4, composed of palladium oxide (PdO) particles with an average particle size of 7 nm, between the electrodes 2 and 3. The conductive film 4 had a thickness of 10 nm and a sheet resistance of $5\times10^4$ Ω (per sheet).

Figure 19M:
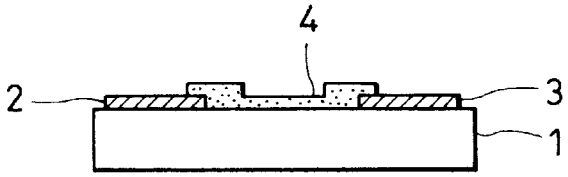

The chromium film 13 was removed by a lift-off technique to form a conductive film 4 as shown in FIG. 19M.

Figure 19N:
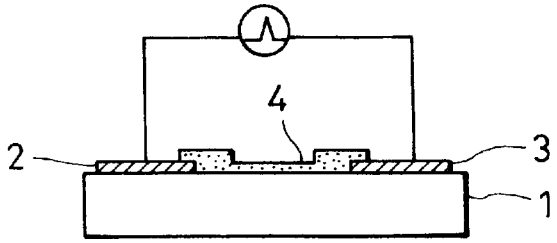
Figure 19O:
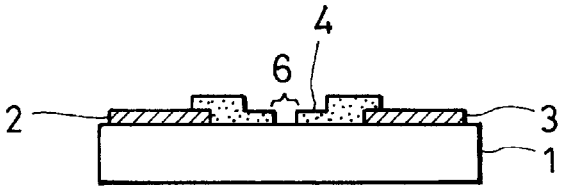

Step 3) The device was placed into a vacuum chamber 55 in a vacuum treatment system shown in FIGS. 6 and 7, and the vacuum chamber 55 was evacuated by a vacuum pump (a magnetic levitation-type turbopump 64). With reference to FIG. 19N, after the pressure in the vacuum chamber reached approximately $2.7\times10^{-6}$ Pa, a pulse device voltage $V_f$ as shown in FIG. 4B was applied between the electrodes 2 and 3 through an electrical power source 51. With reference to FIG. 19O, a crack 6 was formed in the conductive film 4 by the electrifying treatment (forming treatment).

In this example, the pulse device voltage $V_f$ had a pulse width $T_1$ of 1 msec and a pulse interval $T_2$ of 10 msec. The pulse height was increased by an increment of 0.1 V during the forming step. In the forming step, a 0.1-V pulse was inserted in the pulse interval $T_2$ to measure the resistance of the device. When the resistance reached approximately 1 MΩ or more, the forming treatment was completed. The forming voltage $V_F$ was approximately 5V. The width of the crack 6 formed by the forming treatment was approximately 150 nm.

Acetone was introduced into the vacuum chamber 44 through a needle valve 59 in FIG. 7. The vacuum pressure was approximately $1.3\times10^{-3}$ Pa. The partial pressure of oxygen in the vacuum chamber 55 was lower than the detection limit ($1.3\times10^{-8}$ Pa). A pulse voltage as shown in FIG. 5A was applied between the electrodes 2 and 3 for activation. The pulse had a width $T_1$ of 100 $\mu$sec, an interval $T_2$ of 10 msec, and a pulse height of 14 V. The vacuum chamber was evacuated to approximately $1.3\times10^{-6}$ Pa.

Before being introduced into the vacuum chamber 55, acetone contained in an ampoule 58 as a supply source was deaerated by a freezing and thawing method using the apparatus shown in FIG. 7, as follows. Into a Pyrex glass ampoule 58, 20 ml of acetone with a purity of 99.5%, made by Kishida Chemical Co., Ltd., was placed, and the ampoule 58 was connected to the needle valve 59, as shown in FIG. 7. Deaeration was performed as follows.

A. The second valve 62 was closed (the needle valve 59 and the first valve 61 were already closed).

B. Acetone in the ampoule 58 was frozen with liquid nitrogen 60.

C. The second valve 62 was fully opened, and the ampoule 58 was evacuated for 20 minutes by an oil-less dry pump 63.

D. The second valve 62 was closed.

E. The acetone was warmed to room temperature to be melted.

F. The procedures B to E were repeated another two or three times.

The device current $I_f$ after the activation step was 3 mA. Then, the needle valve 59 was closed, and the vacuum chamber and the device were heated at 200° C. for 12 hours in the vacuum. The pressure of the vacuum chamber after cooling to room temperature was approximately $1\times10^{-6}$ Pa.

Characteristics of the resulting electron emission device were measured at an anode voltage of 1 kV and a distance H between the anode and the electron emission device of 4 mm. The device current $I_f$ was 2 mA and the emission current $I_e$ was 1.2 $\mu$A for a device voltage $V_f$ of 14 V. Thus, the electron emission efficiency $\eta(=I_e/I_f)$ was 0.06%.

Example 2

The device after the forming treatment was subjected to electrifying treatment in a benzonitrile containing atmosphere as an activation step. Benzonitrile (20 ml) having a purity of 99% (made by Kishida Chemical Co., Ltd.) contained in an ampoule was deaerated by a freeze and thawing method using the apparatus shown in FIG. 20, as follows.

A. The needle valve 159 was closed.

B. Benzonitrile in the stainless steel ampoule 158 was frozen with liquid nitrogen 160.

C. The needle valve 159 was fully opened and the ampoule 158 was evacuated for 20 minutes using a magnetic levitation-type turbopump 164.

D. The needle valve 159 was closed.

E. The benzonitrile was warmed to room temperature to be melted.

F. The procedures B to E were repeated another two or three times.

The benzonitrile-containing ampoule 158 with the needle valve 159 was separated from the deaeration apparatus and was attached to the vacuum treatment system shown in FIG. 7. After the vacuum chamber, the gas line and the dead space were thoroughly evacuated by a magnetic levitation-type turbopump until the vacuum pressure in the vacuum chamber reached approximately $1\times10^{-5}$ Pa.

The needle valve was opened so that the benzonitrile vapor was introduced into the vacuum chamber containing the device after the forming treatment, while the vacuum chamber was evacuated by the magnetic levitation-type turbopump so that the vacuum pressure was maintained at approximately $1\times10^{-4}$ Pa by adjusting the needle valve.

The partial pressures of oxygen and nitrogen in the vacuum chamber according to a quadrupole mass spectrometer were less than $1\times10^{-9}$ Pa and less than $1\times10^{-8}$ Pa, respectively.

A rectangular voltage as shown in FIG. 5B was applied between the electrodes 2 and 3 for one hour. The pulse width $T_1$ and the pulse interval $T_2$ of the wave voltage were 1 msec and 10 msec, respectively. The pulse height of the rectangular voltage was 14V. The device current $I_f$ after the activation step was 6 mA. Then, the needle valve was closed, and the vacuum chamber and the device were heated to 200° C. for 12 hours in the vacuum. The pressure of the vacuum chamber after cooling to room temperature was approximately $1\times10^{-6}$ Pa.

The device current $I_f$ and the emission current were measured as in Example 1. The device current $I_f$ was 4 mA and the emission current $I_e$ was 4 $\mu$A for a device voltage $V_f$ of 14 V. Thus, the electron emission efficiency $\eta$ was 0.1%.

Comparative Example 1

An electron emission device was evaluated as in Example 1 using acetone which was not deaerated.

The device current $I_f$ after the activation step was 2 mA. The device current $I_f$ and the emission current were measured as in Example 1. The device current $I_f$ was $_{1.5}$ mA and the emission current $I_e$ was 0.2 $\mu$A for a device voltage $V_f$ of 14 V. Thus, the electron emission efficiency $\eta$ was 0.013%.

Comparative Example 2

Figure 20:
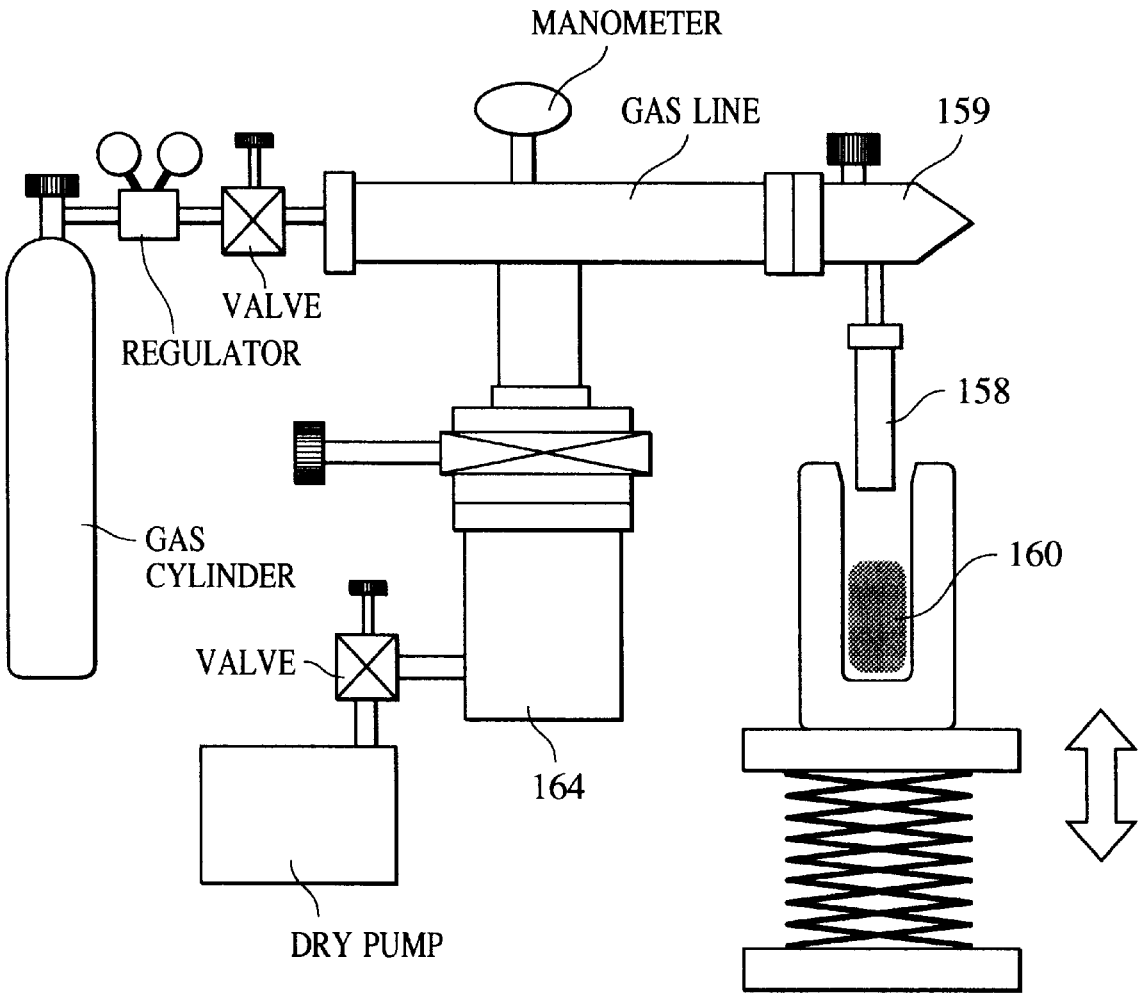
FIG. 20 is a schematic view of a deaeration unit in a feed system of an organic substance in accordance with the present invention.

An ampoule with a needle valve containing benzonitrile which was deaerated as in Example 1 was removed from the deaeration apparatus shown in FIG. 20. The needle valve was opened to the atmosphere for 2 seconds, and was then closed. The subsequent treatment was performed as in Example 1.

The partial pressures of oxygen and nitrogen in the vacuum chamber were $1\times10^{-7}$ Pa and $5\times10^{-7}$ Pa, respectively.

The device current $I_f$ and the emission current were measured as in Example 1. The device current $I_f$ was 1.5 mA and the emission current $I_e$ was 0.2 $\mu$A for a device voltage $V_f$ of 14 V. Thus, the electron emission efficiency $\eta$ was 0.013%.

Example 3

An image forming apparatus shown in FIG. 14 was produced using a ladder-type electron source substrate 110 shown in FIG. 13 including a plurality of lines of electron emission devices 111 formed on a substrate. Devices 111, each having a pair of electrodes 2 and 3 and a conductive film 4 formed therebetween (See FIG. 19M), were prepared as in Example 1.

The electron source substrate 110 was fixed to a rear plate 81 shown in FIG. 14, and grid electrodes (modulation electrodes) 120 having openings 121 were disposed perpendicular to the common lead lines 112 on the electron source substrate 110.

A face plate 86 (a glass substrate with a fluorescent film and a metal back layer formed on the inner face) was exactly aligned on the electron emission devices of the electron source substrate 110 by a frame 82 so that the face plate 86 is 5 mm distant from the electron emission devices. A frit glass was applied to the connections between the face plate 86, the frame 82, and the rear plate 81, and melted at 430° C. for 10 minutes or more to seal the connections. The electron source substrate 110 was fixed to the rear plate 81 using the frit glass.

The fluorescent film 84 had a striped pattern, as shown in FIG. 11A, for a color image forming apparatus. Black stripes 91*a* were formed and color fluorescent substances 92 were applied to the gaps between the black stripes 91*a*. The back stripes 91*a* were composed of graphite as a major component.

A metal back layer 85 was formed on the inner face of the fluorescent film 84, by smoothing (referred to as filming) the inner face of the fluorescent film 84 and then by depositing aluminum thereon by a vacuum deposition process.

Since the metal back layer 85 had high conductivity in this example, no transparent electrode, which enhances conductivity of the fluorescent film 84, was formed on the outer face of the fluorescent film 84.

The resulting glass container (envelope) was evacuated by a vacuum pump through an exhaust tube (not shown in the drawing) to a sufficient vacuum pressure. A voltage was applied between the electrodes 2 and 3 of each device through the external terminals $D_{ox1}$ to $D_{oxm}$ to form a crack 6, as shown in FIG. 19O, in the conductive film 4 of the device. The forming conditions were the same as those in Example 1.

Into the glass vessel, $1.3\times10^{-2}$ Pa of acetone, which was deaerated as in Example 1, was introduced, and then a voltage was applied between the electrodes 2 and 3 of each device through the external terminals $D_{ox1}$ to $D_{oxm}$ for activation. Carbonaceous compounds were deposited on each device. The glass vessel was evacuated to a vacuum pressure of approximately $6.7\times10^{-5}$ to remove acetone, and the exhaust tube (not shown in the drawing) was sealed and cut by a gas burner. The sealed glass vessel was subjected to getter treatment by a radiofrequency heating process to maintain a high vacuum.

In the resulting image forming apparatus, voltages are applied to electron emission devices through the external terminals $D_{ox1}$ to $D_{oxm}$ to emit electrons. The emitted electrons pass through the openings 121 of the modulation electrodes 120, are accelerated by a high voltage of several kV or more which is applied to the metal back layer 85 from a high voltage terminal Hv, and collide with the fluorescent film 84 to emit light. Voltages in response to image signals are simultaneously applied to the modulation electrodes 120 through the external terminal $G_1$ to $G_n$ to control electron beams passing through the openings 121. The apparatus thereby displays an image.

In this example, the modulation electrodes 120 had openings 121 with a diameter of 50 $\mu$m and was disposed at a position which is $_{10}$ $\mu$m distant from the electron emission device 110, and an $SiO_2$ insulating layer (not shown in the drawing) was disposed between the modulation electrodes and the electron source substrate 110. When an acceleration voltage of 6 kV was applied, the ON and OFF modes of the electron beams were controllable within a modulation voltage of 50 V.

Example 4

Figure 9:
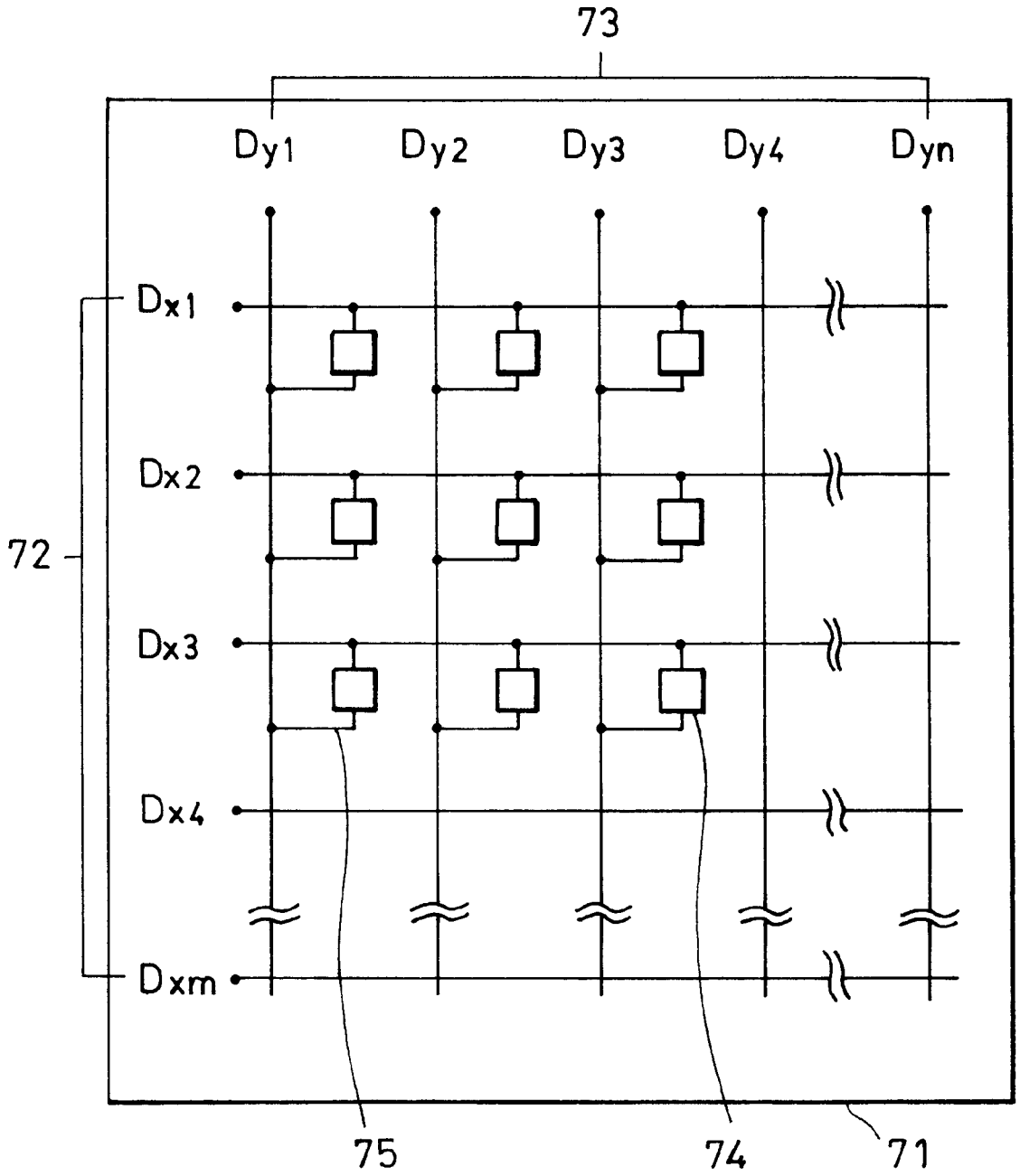
FIG. 9 is a schematic view of a simple matrix electron source in accordance with the present invention.
Figure 21:
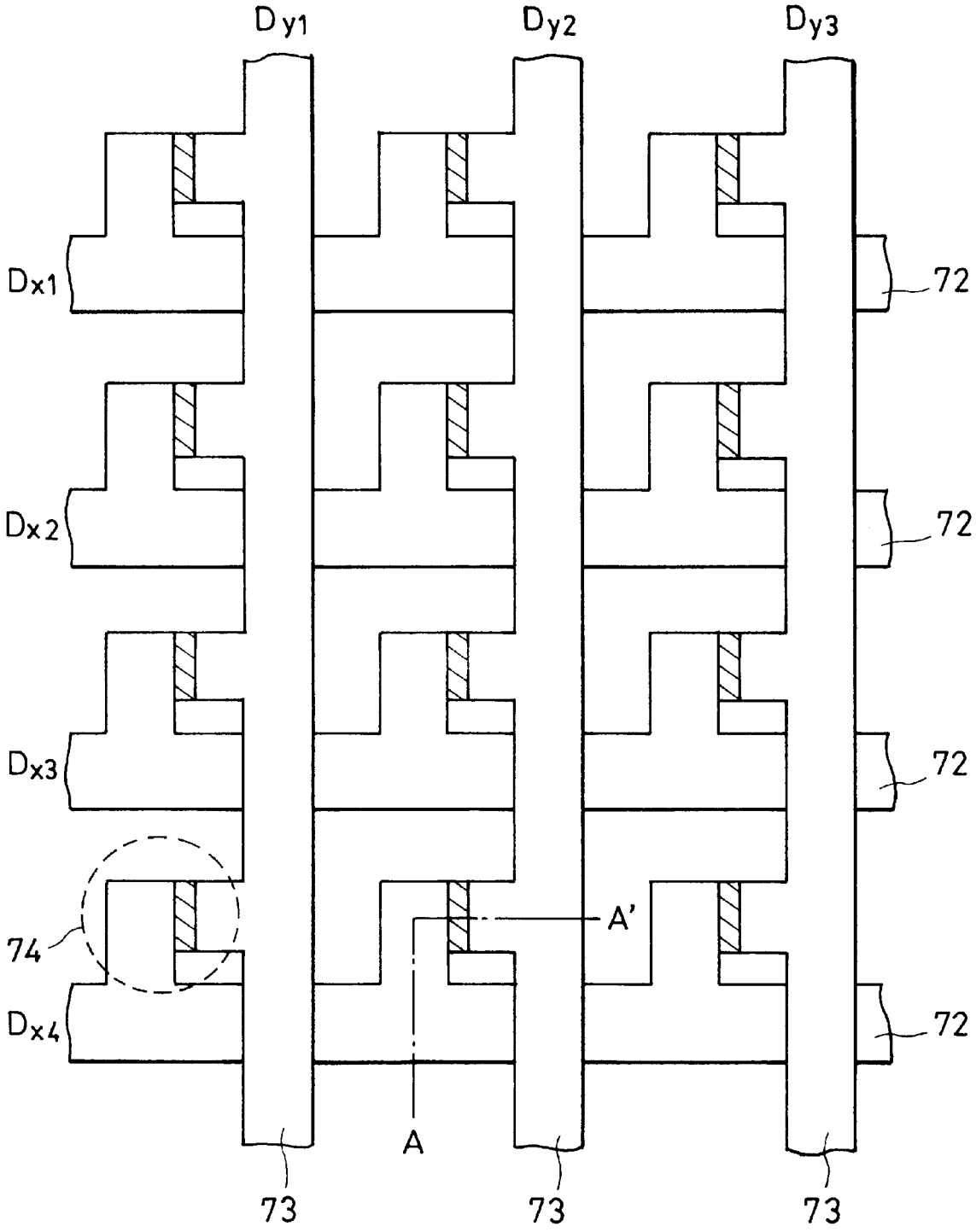
FIG. 21 is a plan view of an electron source in accordance with the present invention.
Figure 22:
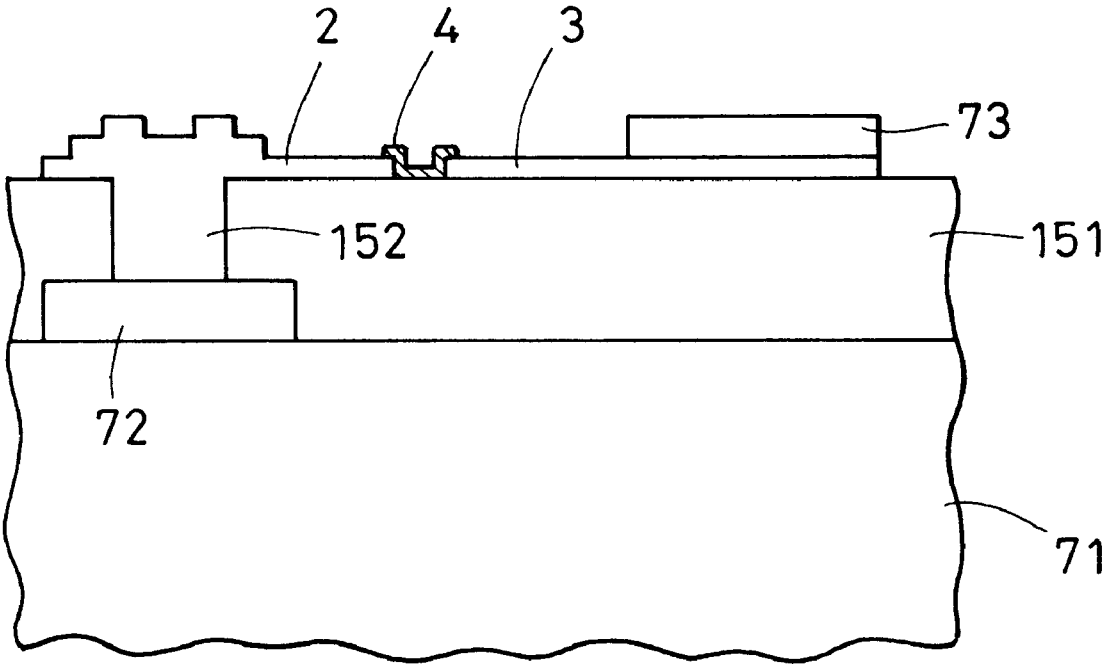
FIG. 22 is a cross-sectional view taken along line XXII—XXII in FIG. 21.
Figure 23A:
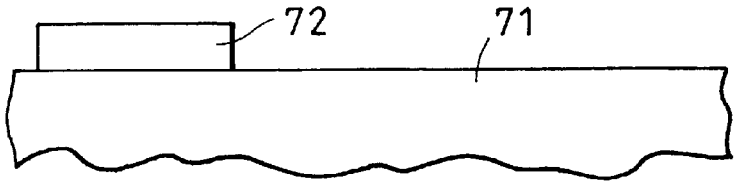
FIGS. 23A to 23D and 24E to 24H are cross-sectional views of a method for making an electron source in accordance with the present invention.
Figure 23B:
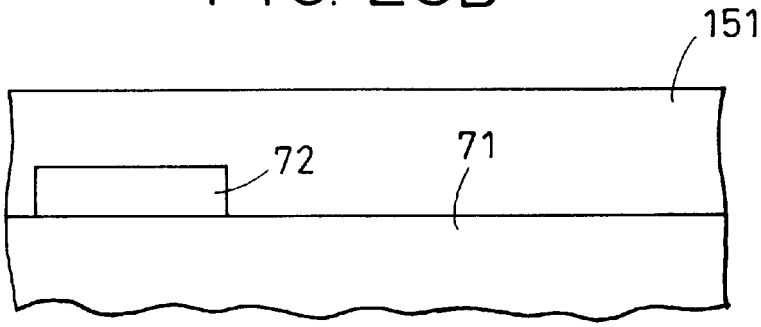
Figure 23C:
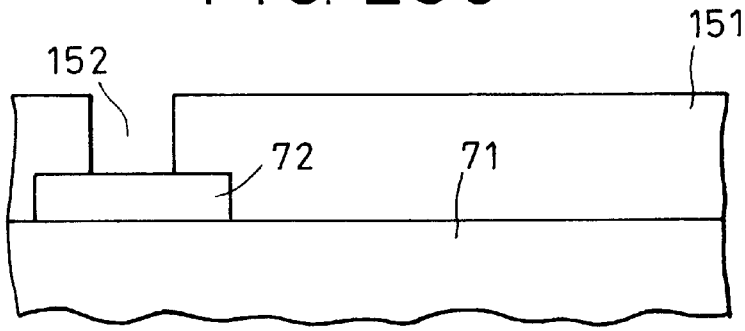
Figure 23D:
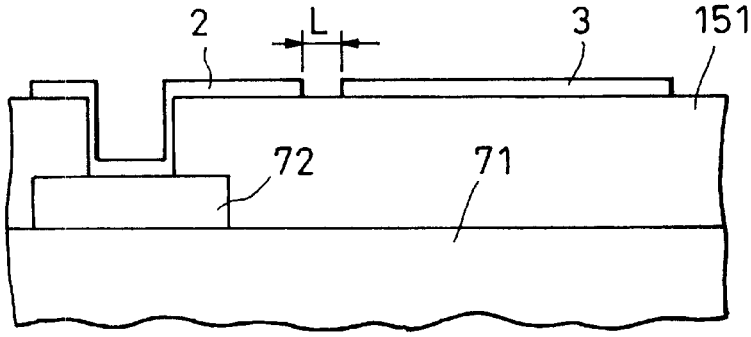
Figure 24E:
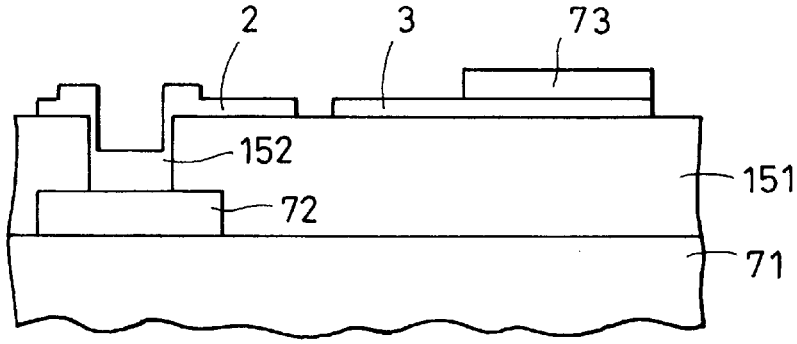
Figure 24F:
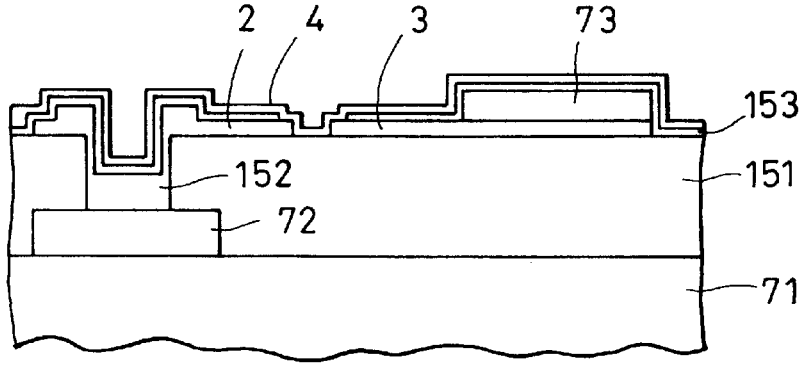
Figure 24G:
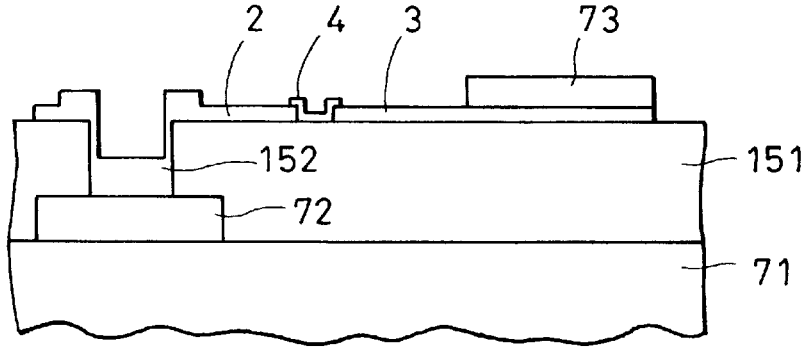
Figure 24H:
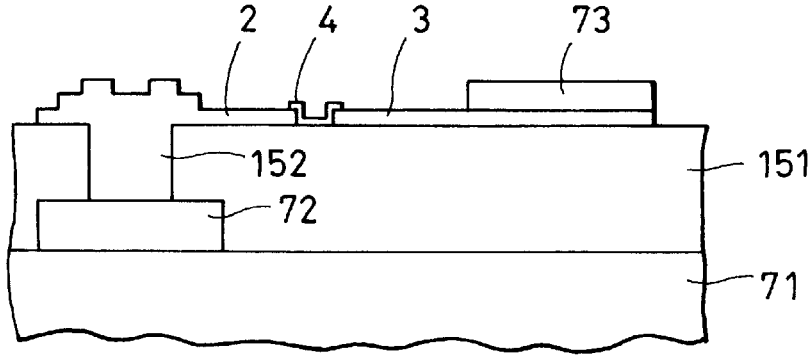
Figure 25:
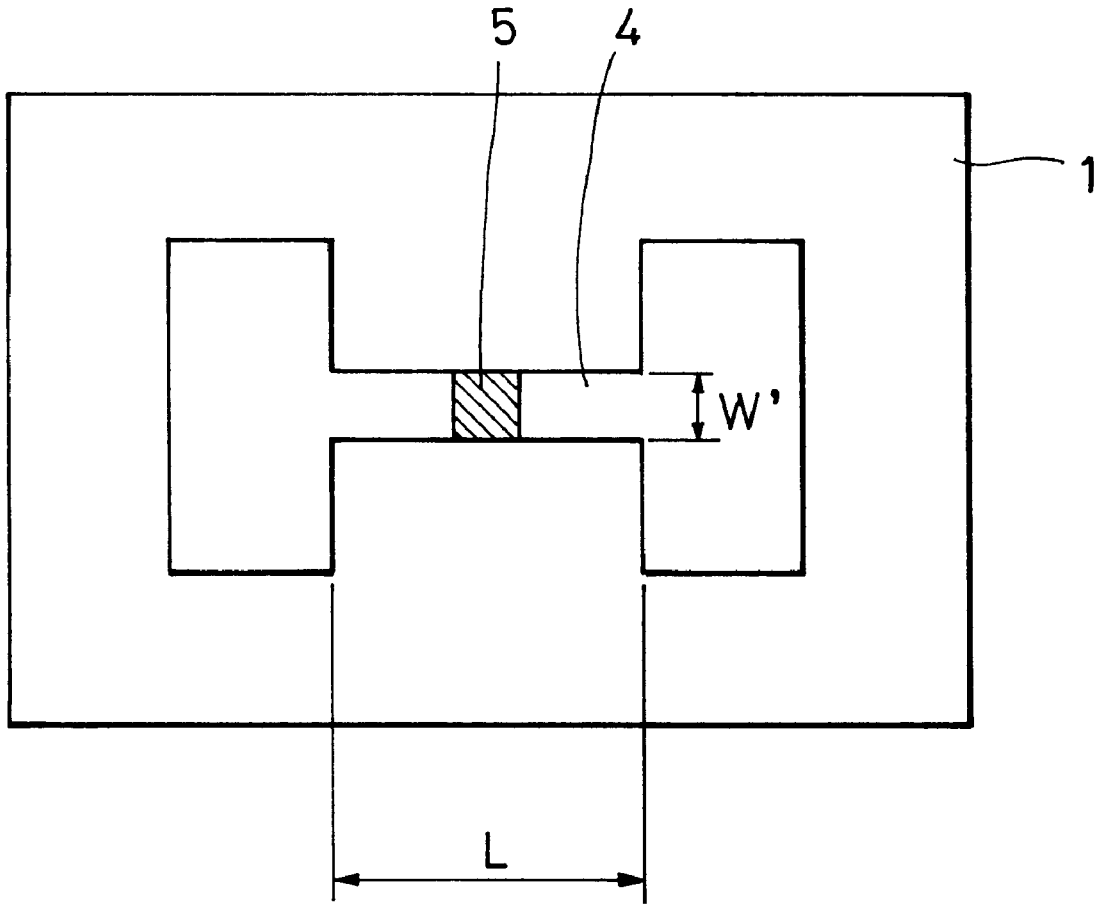
FIG. 25 is a schematic view of a conventional surface conductive electron emission device.

In this example, an image forming apparatus shown in FIG. 10 was produced using an electron source substrate, as shown in FIG. 9, which includes electron emission devices arranged in a simple matrix. FIG. 21 is a partial plan view of the electron source substrate. FIG. 22 is a cross-sectional view taken along line XXII—XXII in FIG. 21. FIGS. 23A to 23D and 24E to 24H show production steps of the electron source substrate. In these drawings, numeral 71 represents an electron source substrate, numeral 72 represents an X-axis lead line (or an underlying line) corresponding to the line $D_{xm}$ in FIG. 9, and numeral 73 represents a Y-axis lead line (or an overlying line) corresponding to the line $D_{yn}$ in FIG. 9. Numeral 151 represents an insulating interlayer, and numeral 152 represents a contact hole for electrically connecting the electrode 2 and the underlying lead line 72.

The electron source substrate has 300 electron emission devices on the X-axis lead line 72 and 100 electron-emitting section on the Y-axis lead line 73.

The method for making the electron source substrate will now be described with reference to FIGS. 23A to 23D and 24E to 24H. The following steps A to H correspond to the steps shown in FIGS. 23A to 23D and 24E to 24H.

Step A) A silicon oxide film with a thickness of 0.5 $\mu$m was formed on a blue plate glass with a thickness of 2.8 nm by a sputtering process to form a substrate 71. Chromium with a thickness of 5 nm, and then gold with a thickness of 600 nm, were deposited thereon. A photoresist AZ1370 made by Hoechst AG was applied by spin coating, was baked, exposed through a photomask, and developed to form a resist pattern for an underlying lead line 72. The gold-chromium film was etched by a wet process to form the underlying lead line 72 having a predetermined pattern.

Step B) A silicon dioxide insulating interlayer 151 with a thickness of 1.0 $\mu$m was deposited thereon by a RF (radiofrequency) sputtering process.

Step C) A photoresist pattern was formed thereon, and then the insulating interlayer 151 was etched using the photoresist pattern as a mask by a RIE (reactive ion etching) process using gaseous $CH_4$ and $H_2$ to form a contact hole 152 in the insulating interlayer 151.

Step D) A photoresist pattern having openings for forming electrodes was formed thereon using a photoresist RD-2000N-41 made by Hitachi Chemical Co., Ltd. Titanium with a thickness 5 nm, and then nickel with a thickness of 100 nm, were deposited thereon. The photoresist pattern was removed by an organic solvent to form electrodes 2 and 3. The resulting electrodes 2 and 3 had an interelectrode distance L of 5 $\mu$m, and a width W of 300 $\mu$m.

Step E) A photoresist pattern having openings for forming the lead line 73 was formed thereon. Titanium with a thickness 5 nm and then gold with a thickness of 500 nm were deposited thereon. The photoresist pattern was removed by an organic solvent to form the lead line 73.

Step F) A patterned chromium film with a thickness of 100 nm was deposited thereon through a mask with an opening for forming a conductive film 4 by a vacuum deposition process. An organic palladium (ccp4230 made by Okuno Chemical Industries, Co., Ltd.) was applied thereon by a spin coating process, and baked at 300° C. for 10 minutes to form the conductive film 4 composed of particulate PdO. The conductive film 4 had a thickness of 10 nm and a sheet resistance of $5\times10^4$ Ω per sheet.

Step G) The chromium film 153 was wet-etched using an acid etchant to form the conductive film 4 having a predetermined shape.

Step H) A resist film was formed so as to cover the portions other than the contact hole 152. Titanium with a thickness of 5 nm, and then gold with a thickness of 500 nm, were deposited thereon by a vacuum deposition process to fill the contact hole 152. The titanium-gold film at the portions other than the contact hole was removed by a lift-off process.

The underlying lead line 72, the insulating interlayer 151, the overlying lead line 73, the electrodes 2 and 3, and the conductive film 4 were thereby formed on the substrate 71.

Using an electron source substrate 71 (in FIG. 21) provided with a plurality of composite films 74 arranged in a matrix, which were made by the above steps, an image forming apparatus was produced. The production procedure will now be described with reference to FIGS. 10 and 11.

The electron source substrate 71 provided with a plurality of composite films 74 arranged in a matrix (FIG. 21) was fixed onto a rear plate 81. A face plate 86 with a frame 82 was exactly aligned on the electron-emitting section 71, in which the face plate 86 included a glass substrate 83, and a fluorescent film 84 and a metal back layer 85 formed on the inner face of the glass substrate 83. A frit glass was applied to the connections between the face plate 86, the frame 82, and the rear plate 81, and was then baked at 430° C. for 10 minutes or more in air. The frit glass was also used for connection of the rear plate 81 and the electron source substrate 71.

The fluorescent film 84 had a striped pattern, as shown in FIG. 11A, for a color image forming apparatus. Black stripes 91*a* were formed and color fluorescent substances 92 were applied to the gaps between the black stripes 91*a*. The back stripes 91*a* were composed of graphite as a major component.

A metal back layer 85 was formed on the inner face of the fluorescent film 84, by smoothing (referred to as "filming") the inner face of the fluorescent film 84 and then by depositing aluminum thereon by a vacuum deposition process.

Since the metal back layer 85 had high conductivity in this example, no transparent electrode, which enhances conductivity of the fluorescent film 84, was formed on the outer face of the fluorescent film 84.

The resulting envelope 88 was evacuated by a vacuum pump through an exhaust tube (not shown in the drawing) to $1.3\times10^{-4}$ Pa. A voltage was applied between the electrodes 2 and 3 of each device through the external terminals $D_{ox1}$ to $D_{oxm}$ and $D_{oy1}$ to $D_{oyn}$ to form an electron-emitting section 5 by a forming treatment. The forming conditions were the same as those in Example 1.

The electron-emitting section 5 was composed of dispersed palladium particles with an average particle size of 3 nm.

Into the envelope 88, $1.3\times10^{-1}$ Pa of acetone, which was deaerated as in Example 1, was introduced as in Example 2, and then a voltage was applied between the electrodes 2 and 3 of each device through the external terminals $D_{ox1}$ to $D_{oxm}$ and $D_{oy1}$ to $D_{oyn}$ for activation. Carbonaceous compounds were deposited on each device. The envelope 88 was evacuated to remove acetone and baked at 120° C. for 10 hours. The exhaust tube (not shown in the drawing) was sealed and cut by a gas burner. The sealed envelope 88 was subjected to getter treatment by a radiofrequency heating process to maintain a high vacuum.

In the resulting display panel, the external terminals $D_{ox1}$ to $D_{oxm}$ (m=100), $D_{oy1}$ to $D_{oyn}$ (n=300), and the high voltage terminal Hv were connected to the corresponding driving system to complete an image forming apparatus. Scanning signals and modulation signals were applied to electron emission devices through the external terminals $D_{ox1}$ to $D_{oxm}$ (m=100) and $D_{oy1}$ to $D_{oyn}$ (n=300) to emit electrons. The emitted electrons were accelerated by a high voltage of several kV or more which is applied to the metal back layer 85 from a high voltage terminal Hv, and collided with the fluorescent film 84 to emit light.

The image forming apparatus in this example has a small depth because of use of the thin display panel. Since the formed electron emission devices have uniform electron emitting characteristics, the formed image is of high quality and high definition.

As described above, the impurities in the organic substance are previously removed before the step forming the thin film composed of carbon or carbonaceous materials on the electron emission device; hence, electron emission devices having superior electron emitting characteristics can be stably produced.

The image forming apparatus according to this method does not have irregular luminance and reduced luminance. Thus, an image forming apparatus having high quality, such as a flat color television, is achieved.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for making an electron emission device including a conductive film having an electron emitting section disposed between a pair of electrodes, comprising:

a removal step for removing impurities except water in an organic substance; and a voltage-applying step for applying a voltage to a conductive film disposed between a pair of electrodes in an atmosphere containing the organic substance having passed through the remocal step.

2. A method for making an electron emission device according to claim 1, wherein the removal step comprises removing impurities except water contained in the organic substance when the organic substance is introduced from a supply source of the organic substance into a treating unit for performing the voltage-applying step.

3. A method for making an electron emission device according to claim 1, wherein the impurities except water are atmospheric components.

4. A method for making an electron emission device including a conductive film having an electron emitting section disposed between a pair of electrodes, comprising:

a removal step for removing impurities in an organic substance in a freezing and thawing method; and a voltage-applying step for applying a voltage to the conductive film disposed between a pair of electrodes in an atmospher containing the organic substance having passed through the removal step.

5. A method for making an electron emission device including a conductive film having an electron emitting section disposed between a pair of electrodes, comprising:

a removal step for removing impurities in an organic substance; and a voltage-applying step for applying a voltage to the conductive film disposed between a pair of electrodes in an atmosphere containing the organic substance having passed through the removal step, wherein the organic substance having passed through the removal step is introduced to a treating unit performing the voltage-applying step without contact with air.

6. A method for making an electron emission device according to either claim 4 or 5, wherein the removal step comprises removing impurities contained in the organic substance when the organic substance is introduced from a supply source of the organic substance into a treating unit for performing the voltage-applying step.

7. A method for making an electron emission device according to either claim 4 or 5, wherein the impurities are atmospheric components.

8. A method for making an. electron emission device according to either claim 4 or 5, wherein the impurities are oxygen.

9. A method for making an electron emission device according to either claim 4 or 5, wherein the impurities are nitrogen.

10. A method for making an electron emission device including a conductive film having an electron emitting section disposed between a pair of electrodes, comprising:

a removal step for removing oxygen in an organic substance; and a voltage-applying step for applying a voltage to the conductive film disposed between a pair of electrodes in an atmosphere containing the organic substance having passed through the removal step.

11. A method for making an electron emission device including a conductive film having an electron emitting section disposed between a pair of electrodes, comprising:

a removal step for removing nitrogen in an organic substance; and a voltage-applying step for applying a voltage to the conductive film disposed between a pair of electrodes in an atmosphere containing the organic substance having passed through the removal step.

12. An apparatus for making an electron emission device, comprising a pair of electrodes and a conductive film having an electron emitting section disposed between the electrodes, comprising:

a container for containing a substrate comprising a pair of electrodes and a conductive film disposed between the electrodes;

a first evacuating means for evacuating the container;

a voltage applying means for applying a voltage between the electrodes;

a gas supply means for supplying a vaporized organic substance from a supply source to the vessel; and a second evacuating means for evacuating the interior of the supply source.

13. An apparatus for making an electron emission device, comprising a pair of electrodes and a conductive film having an electron emitting section disposed between the electrodes, comprising:

a container for containing a substrate comprising a pair of electrodes and a conductive film disposed between the electrodes;

an evacuating means for evacuating the container;

a voltage applying means for applying a voltage between the electrodes;

a gas supply means for supplying a vaporized organic substance from the interior of a supply source to the container; and a gas exhausting line for evacuating the interior of the supply source, by operation of the evacuating means, without passing the contents of said interior through the container.

14. A method for making an image forming apparatus comprising at least one electron emission device and an image forming member for forming an image emitting electrons from the electron emission device, wherein the electron emission device is made by a method according to claim 1, 4, 5, 10 or 11.

15. A method for making an electron emission device according to claim 10, wherein oxygen in the organic substance is removed in a freezing and thawing method.

16. A method for making an electron emission device according to claim 10, wherein the removal step comprises removing oxygen contained in teh organic substance when the organic substance is introduced from a supply source of the organic substance into a treating unit for performing the voltage-applying step.

17. A method for making an electron emission device according to claim 11, wherein nitrogen in the organic substance is deleted in a freezing and thawing method.

18. A method for making an electron emission device according to claim 11, wherein the removal step comprises removing nitrogen contained in the organic substance when the organic substance is introduced from a supply source of the organic substance into a treating unit for performing the voltage-applying step.

* * * * *

UNITED STATES PATENT AND TRADEMARK OFFICE

CERTIFICATE OF CORRECTION

PATENT NO. : 6,213,834 B1
DATED : April 10, 2001
INVENTOR(S) : Toshikazu Ohnishi et al.

It is certified that error appears in the above-identified patent and that said Letters Patent is hereby corrected as shown below:

Title page,
Item [57] ABSTRACT, "an" should read -- a --.

Column 1,
Line 25, "%" should be deleted.

Column 3,
Line 8, "an" should read -- a --.

Column 5,
Line 14, "nanometer." should read -- nanometers. --; and
Line 61, "(1988))" should read -- (1988)). --.

Column 24,
Line 41, "remocal" should read -- removal --; and
Line 59, "atmospher" should read -- atmosphere --.

Column 25,
Line 15, "an." should read -- an --.

Column 26,
Line 35, "teh" should read -- the --.

Signed and Sealed this

Twenty-sixth Day of March, 2002

*Attest:*

*Attesting Officer*

JAMES E. ROGAN
*Director of the United States Patent and Trademark Office*